US007090903B2

(12) United States Patent
Katoh et al.

(10) Patent No.: US 7,090,903 B2
(45) **Date of Patent: *Aug. 15, 2006**

(54) INK-JET RECORDING SHEET

(75) Inventors: Eisaku Katoh, Hachioji (JP); Atsushi Tomotake, Hino (JP); Toshihiko Iwasaki, Hachioji (JP); Masayuki Ushiku, Yokohama (JP); Junji Ito, Hino (JP); Yukako Taka, Hachioji (JP)

(73) Assignee: Konica Corporation, Tokyo (JP)

( * ) Notice: Subject to any disclaimer, the term of this patent is extended or adjusted under 35 U.S.C. 154(b) by 19 days.

This patent is subject to a terminal disclaimer.

(21) Appl. No.: 10/673,104

(22) Filed: Sep. 26, 2003

(65) Prior Publication Data

US 2004/0065230 A1 Apr. 8, 2004

(30) Foreign Application Priority Data

| | | |
|---|---|---|
| Oct. 7, 2002 | (JP) | 2002-293469 |
| Nov. 22, 2002 | (JP) | 2002-339001 |
| Mar. 10, 2003 | (JP) | 2003-063003 |

(51) Int. Cl.
*B41M 5/00* (2006.01)

(52) U.S. Cl. ..... 428/32.15; 428/32.38

(58) Field of Classification Search ..... 428/32.15, 428/32.3

See application file for complete search history.

(56) References Cited

U.S. PATENT DOCUMENTS

| | | | | |
|---|---|---|---|---|
| 6,616,991 | B1 * | 9/2003 | Uto | 428/32.24 |
| 2001/0031341 | A1 | 10/2001 | Kronzer et al. | |

FOREIGN PATENT DOCUMENTS

| | | |
|---|---|---|
| JP | 2001205929 | 5/2001 |
| WO | WO 00/41890 A | 7/2000 |

* cited by examiner

*Primary Examiner*—Pamela R. Schwartz
(74) *Attorney, Agent, or Firm*—Lucas and Mercanti, LLP

(57) ABSTRACT

An ink-jet recording sheet, comprising a support having thereon a porous ink receiving layer, the porous ink receiving layer including inorganic particles, a hydrophilic binder and a polymer, wherein the polymer has a plurality of carbon-carbon unsaturated bonds, provided that the unsaturated bonds are non-aromatic; the polymer has a recurring unit derived from butadiene or isoprene.

11 Claims, No Drawings

INK-JET RECORDING SHEET

TECHNICAL FIELD

The present invention relates to an ink-jet recording sheet (hereinafter, referred to simply as a recording sheet) which is used for ink-jet image recording.

BACKGROUND

In recent years, rapid improvement of ink-jet recording materials has been realized, resulting in almost similar quality to that of conventional silver halide photography. Specifically, in order to achieve image quality comparable with silver halide photography by ink-jet recording, improvement has been enhanced in regard to ink-jet recording sheets. Porous type recording sheets comprise a very flat and smooth support having a porous layer of minute voids thereon, which comprises a pigment and a hydrophilic polymer, exhibits high glossiness and brilliant coloration, and further exhibits superiority in ink absorbability and drying, resulting in a material showing almost identical quality of silver halide photography. Specifically, when a non-absorbing support is employed, a much higher quality print can be obtained, since cockling after printing, so-called wrinkling, is not generated, which is often observed on an absorbing support, resulting in maintaining excellent smoothness of the surface.

Ink-jet recording is generally divided into two categories, one of which is using a water based ink employing water and a water soluble solvent as ink solvents, and the other is using a non-water based ink employing an oil soluble solvent. Each of these consists of two types, using either a dye or a pigment as a colorant, and thus, it is necessary to use specially prepared sheet adaptive to each type to obtain the desired high quality recorded images. As to ink, water based ink is the more common type due to a lesser burden on the environment, and handling safety.

Pigment ink results in high durability of images, but tends to change glossiness of the image as imagewise, resulting in lowered image quality. On the other hand, when water soluble dye ink is used, color prints with sharp image details and also uniform surface glossiness can be obtained, the quality of prints is comparable with silver halide photographic quality.

However, even though this water soluble dye can form high quality images, its image stability is inferior to that of pigment ink images. Therefore, relatively severe discoloration by sunlight or indoor light, or by an oxidizing gas such as ozone in ambient air has been a major issue. Specifically, in a porous type recording sheet provided a porous layer of minute voids thereon, the contact area of a dye and ambient air is large, the result is that the dye images tend to be easily affected by oxidizing gases in ambient air. Thus, it has remained a desire to overcome these problems.

To prevent these problems of deterioration with storage, numerous addition of various anti-oxidizing agents as anti-discoloration agents (or light-fastness improving agents) have been proposed.

Examples of these proposals include, for example, ink-jet recording sheets containing various compounds as anti-oxidizing agents as described in JP-A Nos. 57-87989, 57-74192 and 60-72785 (hereinafter, the term JP-A refers to as Japanese Patent Application Publication); ink-jet recording sheets containing ultraviolet absorption agents as described in JP-A 57-74193; addition of hydrazides as described in JP-A 61-154989; addition of hindered amine type anti-oxidizing agents as described in JP-A 61-146591; addition of nitrogen-containing heterocyclic mercapto compounds as described in JP-A 61-177279; addition of thioether type anti-oxidizing agents as described in JP-A Nos. 1-115677 and 1-35479; addition of specific structured hindered phenol type anti-oxidizing agents as described in JP-A 1-36480; addition of hindered phenol type anti-oxidizing agents in combination with hindered amine type anti-oxidizing agents as described in JP-A 3-13376; addition of ascorbic acides as described in JP-A Nos. 7-195824 and 8-150773; addition of zinc sulfate as described in JP-A 7-149037; thiocyanates to be incorporated as described in JP-A 7-314882; addition of thiourea derivatives as described in JP-A 7-314883; saccharides to be incorporated as described in JP-A Nos. 7-276790 and 8-108617; addition of phosphoric acid type anti-oxidizing agents as described in JP-A 8-118791; addition of nitrites, sulfites or thiosulfates as described in JP-A 8-300807; and addition of hydroxylamine derivatives as described in JP-A 9-267544.

However, in an ink-jet recording sheet having minute pores, the desired effects of the addition of an anti-oxidizing agent is not always adequate. In cases when these various anti-discoloration agents are added in a large amount, the problem of lowered ink absorbability of a porous layer exists.

On the other hand, it is well known that resins having unsaturated bonds in a molecule, such as butadiene rubber, can be employed in ink-jet recording sheets. For example, using methods for the resins to mainly absorb solvents of oil based ink are disclosed in JP-A Nos. 2000-177234, 2000-238407, 2001-205929, 11-165460, 11-99742 and WO 00/41890. Further, a method to improve absorbability of water based ink is disclosed, in which a diene type polymer or its hydrate is sulfonated to become hydrophilic. Still further, it is also disclosed that storage stability is improved by combination with a specific dye using styrene-butadiene latex containing 20–45% of a butadiene component as a binding agent, in which the latex is used as a binding agent, resulting in a low butadiene ratio, and therefore, resulting in a limited effect. Furthermore, the technology to prevent bleeding over time under high temperature and high humidity and to prevent discoloration of formed images over time, by adding a compound having an aliphatic carbon-carbon double bond in the molecule (for example, patent documents 1 and 2), but its anti-gas discoloration effect is insufficient.

Patent document 1: JP-A 2002-264478

Patent document 2: JP-A 2000-263928

SUMMARY

From the viewpoint of the foregoing, the present invention has been realized. An object of the present invention is to provide a very gloss ink-jet recording sheet which exhibits excellent ink absorbability and superiority in anti-gas discoloration effect, and prevents film layer delamination.

The foregoing object of the present invention was realized with the following ink-jet recording sheets.

1. An ink-jet recording sheet, comprising a support having thereon a porous ink receiving layer, the porous ink receiving layer including inorganic particles, a hydrophilic binder and a polymer, wherein the polymer has a plurality of carbon-carbon unsaturated bonds, provided that the unsaturated bonds are non-aromatic; the polymer has a recurring unit derived from butadiene or isoprene; and the polymer has 30 to 10000 carbon atoms in the molecule.

2. The ink-jet recording sheet of item 1, wherein the polymer has 70 to 1000 carbon atoms in the molecule.
3. The ink-jet recording sheet of item 1, wherein the polymer is polybutadiene or polyisoprene.
4. The ink-jet recording sheet of item 1, wherein the porous ink receiving layer contains 1,2-polybutadiene in an amount of not less than 60 weight % based on the total weight of the polymer.
5. The ink-jet recording sheet of item 1, wherein the porous ink receiving layer further contains a anti-discoloration agent.
6. The ink-jet recording sheet of item 5, wherein the anti-discoloration agent is selected from the group consisting of:
   (i) phenol compounds;
   (ii) sulfur containing compounds;
   (iii) amine compounds;
   (iv) multivalent metal salts;
   (v) phosphor containing compounds;
   (vi) alcohols; and
   (vii) benzotriazoles or benzophenones.
7. The ink-jet recording sheet of item 1, wherein the porous ink receiving layer further contains a fluorescent whitening agent.
8. The ink-jet recording sheet of item 1, wherein the porous ink receiving layer further contains a surface active agent.
9. The ink-jet recording sheet of item 1, wherein the inorganic particles are silica, alumina or alumina hydrate.
10. The ink-jet recording sheet of item 1, wherein the inorganic particles have an average particle diameter of not more than 200 nm.
11. The ink-jet recording sheet of item 1, wherein the porous ink receiving layer further contains a cationic polymer.
12. The ink-jet recording sheet of item 1, wherein the porous ink receiving layer further contains an antimicrobial agent.
13. The ink-jet recording sheet of item 1, wherein the porous ink receiving layer further contains a polyvinyl alcohol having an average polymerization degree of not less than 3000.

As a result of study of the foregoing problems, the inventors of the present invention discovered that in ink-jet recording sheets comprising a support, a porous ink absorbing layer thereon containing inorganic fine particles and a hydrophilic binder, discoloration of images over time is significantly reduced without lowering of ink absorbability, while further containing a compound which contains a plurality of non-aromatic carbon-carbon unsaturated bonds in the molecule in the porous ink absorbing layer, and the carbon number of the compound being 30–10,000. Further, anti-discoloration effect is more powerful when a compound having a plurality of non-aromatic carbon-carbon unsaturated bonds in the molecule in the porous ink absorbing layer, and the compound is polybutadiene containing at least 60% of a 1,2-bonded type. Furthermore, the inventors found that it is possible to provide a very gloss ink-jet recording sheet exhibiting no delamination which tends to occur when the sheet is used as a laminate-free poster.

For that reason, the inventors estimate the following. In a porous ink absorbing layer (hereinafter, refers to also as a porous layer or a void layer) using inorganic fine particles, many minute voids present in an ink absorbing layer, and consequently, a oxidizing gas such as an ozone gas specifically tends to enter the voids. It is also well known that discoloration of dyes is caused by assimilation of the oxidizing gas into a porous layer. However, it has recently been proved that it is possible to provide a very gloss ink-jet recording sheet by containing a compound having a plurality of non-aromatic carbon-carbon unsaturated bonds in the molecule in the porous ink absorbing layer, and the compound having a carbon number of at least 30, since the carbon-carbon unsaturated bonds react effectively with an oxidizing gas to prevent discoloration of dyes. Of these compounds, preferred are polybutadiene or polyisoprene, and further, a 1,2-bonded type polybutadiene exhibits specifically preferable effects because there are carbon-carbon unsaturated bonds in the side chains, tending to easily react with an oxidizing gas. In cases when the carbon number is less than 30, the unsaturated bonds are few, resulting in difficulty to exhibit anti-discoloration effects, and on the other hand, if the carbon number is above 10,000, a compound itself is unstable, resulting in also difficulty to exhibit anti-discoloration effects. Further, due to the characteristics of a 1,2-bonded type polybutadiene to easily harden, that butadiene can prevent delamination which tends to occur in the case of lamination-free usage as posters. Further, in cases when a surface active agent or an antimicrobial agent is contained in the porous layer, an emulsion solution of the compound having a plurality of carbon-carbon unsaturated bonds is stabilized, to obtain a stable anti-discoloration effect of dyes.

In cases when the porous ink absorbing layer contains polyvinyl alcohol, much higher glossiness can be obtained with 60% or more degree of saponification of polyvinyl alcohol, and a much more stable delamination preventing effect can be obtained with a 3,000 or more degree of polymerization of polyvinyl alcohol.

DESCRIPTION OF THE PREFERRED EMBODIMENTS

The present invention will now be detailed below. Firstly, fine inorganic particles of this invention will be described.

As fine inorganic particles, various solid fine particles commonly known in the ink-jet recording sheet art may be employed.

Cited as examples of the fine inorganic particles may be white inorganic pigments such as light precipitated calcium carbonate, heavy calcium carbonate, magnesium carbonate, kaolin, clay, talc, calcium sulfate, barium sulfate, titanium dioxide, zinc oxide, zinc hydroxide, zinc sulfide, zinc carbonate, hydrotalcite, aluminum silicate, diatomaceous earth, calcium silicate, magnesium silicate, synthetic non-crystalline silica, colloidal silica, alumina, colloidal alumina, pseudo boehmite, aluminum hydroxide, lithopone, zeolite, and magnesium hydroxide.

The foregoing fine particles may be employed in a state such that primary particles are uniformly dispersed in binders without any modification, or in a state such that secondary coagulated particles are formed which are dispersed into the binders. However, the latter is preferred from the viewpoint of achieving high ink absorbability.

The shape of the foregoing fine inorganic particles is not specifically limited which may be spherical, cylindrical, acicular, tabular, or beaded form.

The average particle diameter of the foregoing fine inorganic particles is preferably at most 200 nm from the viewpoint of obtaining a recording sheet achieving high ink absorbability and high glossiness.

In cases when the average particle diameter is 200 nm or less, high glossiness of the recording sheet can be achieved, and further, sharp images can be obtained without lowered maximum density by diffused reflection at the surface.

The average diameter of the fine particles may be determined as follows. The particles themselves, or the cross-section or surface of a void layer, is observed employing an electron microscope, and each diameter of numerous randomly selected particles is determined. The simple average (being the number average) is obtained as the diameter of the particles based on the determined diameter. Herein, each particle diameter is represented by the diameter of the circle having the same projection area as that of the particle.

Composite particles comprised of fine inorganic particles and a small amount of organic materials (which may be either lower molecular weight compounds or polymers) are basically designated as the fine inorganic particles according to the present invention. Even in this case, the diameter of the highest order particles observed in the dried layer is determined as that of the fine inorganic particles.

The ratio of organic materials/fine inorganic particles in the foregoing composite particles comprised of fine inorganic particles and a small amount of organic materials is generally from 1/100–1/4.

Preferred as the fine inorganic particles according to the present invention are those which are less expensive to produce, have a low refractive index from the viewpoint of being capable of high reflection density, such as silica, alumina and alumina hydrate. Of these, silica synthesized employing a gas phase method, colloidal silica, alumina synthesized employing a gas phase method, colloidal alumina or pseudo boehmite is more preferred.

Further, it is possible to employ cation surface-treated silica, synthesized by employing a gas phase method, cation surface-treated colloidal silica, alumina, colloidal alumina, and pseudo boehmite.

The added amount of fine inorganic particles, employed in the porous layer, depends largely on the desired ink absorption capacity, the void ratio of the void layer, the kinds of fine inorganic particles, and the kinds of water soluble binders, but is generally from 3–30 g per $m^2$ of the recording sheet, and is preferably from 5–25 g/$m^2$. The ratio of fine inorganic particles to a water soluble binder, employed in the ink absorbing layer, is generally from 2:1–20:1, and is specifically preferably from 3:1–10:1.

As the added amount of the fine inorganic particles increases, the ink absorption capacity also increases, while curling and cracking tend to deteriorate. Accordingly, a method, in which the ink absorption capacity is increased by controlling the void ratio, is more preferred. The void ratio is preferably 40–75%. It is possible to control the void ratio utilizing the selected inorganic fine particles, the kinds of binders, or the mixing ratio thereof, or the amount of other additives.

The void ratio, as described herein, is the ratio of the total volume of voids to the volume of the void layer, and can be calculated utilizing the total volume of the layer constituting materials and the thickness of the layer. Further, the total volume of the voids is easily determined through the saturated transition amount and the absorbed water amount utilizing Bristow's Measurement.

Next, a hydrophilic binder used in ink-jet recording sheet of this invention will be described.

The term "hydrophilic" means not only soluble to water but also soluble to a mixed solvent of water and water-miscible organic solvents such as methanol, isopropyl alcohol and acetone. In this case, the amount of water-miscible organic solvents is generally 50 weight % or less to the total amount of solvents.

Further, a hydrophilic binder means a binder which can be dissolved usually in an amount of 1 weight % or more into the foregoing solvents at room temperature (15 to 25° C.), and preferably dissolved in an amount of 3 weight % or more.

Examples of hydrophilic polymers used in this invention include polyvinyl alcohol, gelatin, polyethylene oxide, polyvinylpyrrolidone, casein, starch, agar, carrageenan, polyacrylic acid, polymethacrylic acid, polyacryl amide, polymethacrylamide, polystyrene sulfonic acid, cellulose, hydroxyethyl cellulose, carboxymethyl cellulose, dextran, dextrin, pullulan, and water soluble polyvinyl butyral. These polymers may be employed in combination of more than 2.

The hydrophilic polymer preferably employed in this invention is polyvinyl alcohol. Polyvinyl alcohols include common polyvinyl alcohol prepared by hydrolyzing polyvinyl acetate, and in addition, modified polyvinyl alcohol such as terminal cation-modified polyvinyl alcohol and anion-modified polyvinyl alcohol having an anionic group.

The average degree of polymerization of polyvinyl alcohol prepared by hydrolyzing vinyl acetate is preferably 1,000 or more, and is more preferably 1,500–5,000. Specifically preferred is employing a high polymerized polyvinyl alcohol having an average degree of polymerization of 3,000–8,000. Further, the saponification ratio is preferably 70–100%, and is more preferably 80–100%, and specifically preferably to employ 90–100%, being a so-called completely saponified polyvinyl alcohol.

Cation-modified polyvinyl alcohols are, for example, polyvinyl alcohols having a primary to a tertiary amino group, or a quaternary ammonium group in the main chain or side chain of the foregoing polyvinyl alcohols as described in JP-A 61-10483, and can be obtained upon saponification of copolymer of ethylenic unsaturated monomers having a cationic group and vinyl acetate.

Listed as ethylenic unsaturated monomers having a cationic group are, for example, trimethyl-(2-acrylamido-2,2-dimethylethyl)ammonium chloride, trimethyl-(3-acrylamido-3,3-dimethylpropyl)ammonium chloride, N-vinylimidazole, N-vinyl-2-methylimidazole, N-(3-dimethylaminopropyl)methacrylamide, hydroxylethyltrimethylammonium chloride, trimethyl-(2-methacrylamidopropyl) ammonium chloride, and N-(1,1-dimethyl-3-dimethylaminopropyl)acrylamide.

The content ratio of monomers containing a cation-modified group of the cation-modified polyvinyl alcohol is 0.1–10 mol % to the vinyl acetate, and is preferably 0.2–5 mol %.

Listed as anion-modified polyvinyl alcohols are, for example, polyvinyl alcohols having an anionic group as described in JP-A 1-206088, copolymers of vinyl alcohols and vinyl compounds having a water solubilizing group as described in JP-A Nos. 61-237681 and 63-307979, and modified polyvinyl alcohols containing a water solubilizing group, as described in JP-A 7-285265.

Further, listed as nonion-modified polyvinyl alcohols are, for example, polyvinyl alcohol derivatives in which a polyalkylene oxide group is added to a part of polyvinyl alcohol as described in JP-A 7-9758, and block copolymers of vinyl compounds having a hydrophobic group and polyvinyl alcohols as described in JP-A 8-25795.

Furthermore, in this invention, polyvinyl alcohol modified with a silyl group is included in polyvinyl alcohol as a modified polyvinyl alcohol.

Further, various types of polyvinyl alcohols, in which the degree of polymerization or modification differs, may be employed in a combination of at least two types.

Also, gelatin, polyethylene oxide or polyvinyl pyrrolidone may be employed in combination with polyvinyl alcohol, and these hydrophilic polymers are preferably used in 0–50 weight % to polyvinyl alcohol, and specifically preferably in the range of 0–20 weight %.

Next, a compound having the plurality of carbon-carbon unsaturated bonds of this invention will be described. Examples of compounds having a plurality of non-aromatic carbon-carbon unsaturated bonds in the molecule containing a carbon number of 30–10,000 usable in this invention include resins such as a resin of homopolymerized butadiene or copolymerized butadiene with other copolymerizing monomer, a diarylphthalate resin, an unsaturated polyester resin, a furan resin, a C5 petroleum resin, a terpene resin, and a cyclopentadiene type resin; copolymers having a plurality of copolymerizing groups such as diallylphthalate, trialylloxy-1,3,5-triazinepentaerythritol tetra(metha)acrylate, trimethylolpropane tri(metha)acrylate, and divinylbenzene, but are not limited to these examples.

Of these compounds, polymers containing butadiene or isoprene monomer are preferable, but specifically preferable are polybutadiene the terminals of which are modified with hydroxyl groups, carboxyl groups, amino groups, or maleic acid anhydride; or polybutadiene or polyisoprene which is copolymerized with styrene, acrylonitrile, or (metha)acrylate.

As to polyisoprene, for example, Poly ip (produced by Idemitsu Petrochemical Co., Ltd.) is available on the market. Also, as to polybuthadiene, for example, Nisso PB (produced by NIPPON SODA CO., LTD.), Nisseki polybutadiene (produced by Nippon Oil Corporation), Poly-bd (produced by Idemitsu Petrochemical Co., Ltd.), Hycar (produced by UBEINDUSTRIES, LTD.), Polyoil (ZEON CORPORATION), and JSR RB (produced by JSR Corporation) are easily available commercially.

Further, of polyisoprene and polybutadiene, polybutadiene containing 1,2-bonded type in an amount of more than 60 wt %, is most preferable, and thus, listed are B-1000 (produced by NIPPON SODA CO., LTD.) and B-2000 (produced by Nippon Oil Corporation).

The adding method of a compound, having non-aromatic carbon—carbon unsaturated bonds in the molecule, the carbon number of which is 30–10,000, to a porous ink absorbing layer may be direct addition to the coating composition forming an ink absorbing layer, or to provide an overcoat onto the ink absorbing layer after a porous layer has been coated and dried. In cases when a coating composition is added as in the former example, employed is a method to add the compound completely dissolved in water, in an organic solvent or a mixed solution of these, or to add a dispersion of minute oil droplets employing an emulsifying dispersion method or a wet milling method. In the case of an emulsifying dispersion, a high boiling point organic solvent may be added if appropriate. In cases when the ink absorbing layer is comprised of a plurality of layers, the resulting solution or dispersion of the compound may be added to the coating composition of only one, some, or all of the layer.

Further, in cases when added in an overcoat method after a porous ink absorbing layer has been formed as in the latter example, it is preferable that the compound, having non-aromatic carbon—carbon unsaturated bonds in the molecule, is provided to an ink absorbing layer after it has been dissolved uniformly in a solvent.

The added amount of a compound, having non-aromatic carbon-carbon unsaturated bonds in the molecule, to a porous ink absorbing layer is not specifically restricted, but is preferably in the range of 0.01–3 g per $m^2$ of the recording sheet. In cases when it is no more than 3 g, it is essential that the compound fills in the voids of the porous ink absorbing layer, thereby maintaining high ink absorbability. Further, when in the range of 0.01 g or more, the effect of this invention is sufficiently brought out. From this point of view, it is more preferable to use a range of 0.1–2 g per $m^2$ of the recording sheet.

The ink jet recording sheet of the present invention preferably contains a cationic polymer to more effectively prevent image bleeding during storage after recording.

Examples of such cationic polymers include; polyethyleneimines, polyallylamines, polyvinylamines, dicyandiamide-polyalkylenepolyamine condensates, polyalkylenepolyamine-dicyandiamideammonium salt condensates, dicyandiamide-formalin condensates, addition polymers of epichlorohydrin-dialkylamine, polymers of diallyldimethylammonium chloride, copolymers of diallyldimethylammonium chloride-$SO_2$, polyvinylimidazoles, copolymers of vinylpyrrolidone-vinylimidazole, polyvinylpyridine, polyamidines, chitosan, cationized starch, polymers of vinylbenzyltrimethylammoniumchloride, polymers of (2-methacroiloxyethyl)trimethylammoniumchloride, and polymers of dimethylaminoethylmethacrylate.

Other examples are cationic polymers described in articles of KAGAKU KOGYO JIHO (Chemical Industry Review) dated Aug. 15, 1998, and Aug. 25, 1998, and polymer dye fixing agents described in "KOBUNSHI YAKUZAI NYUMON" (Introduction to High-Molecular Agent), pg. 787, (1992), published by Sanyo Chemical Industries, Ltd.

Examples of cationic polymers which can be used in the present invention are as follows.

P-1b

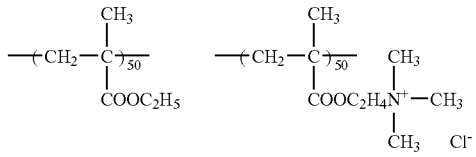

Mn = 20,000

P-2b

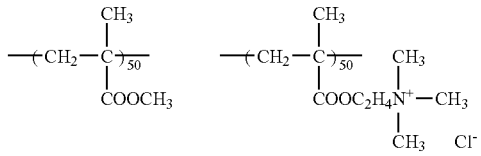

Mn = 25,000

P-3b

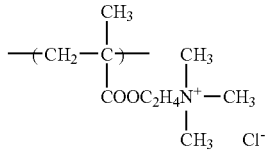

Mn = 50,000

P-4b

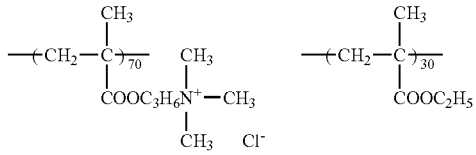

Mn = 63,000

-continued
P-5b
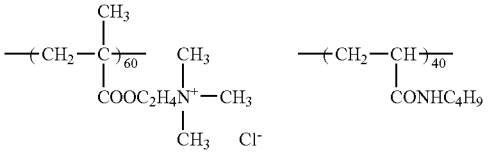
Mn = 19,000
P-6b
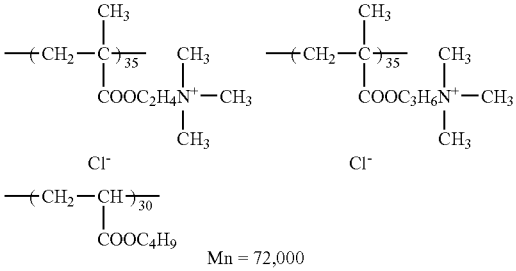
Mn = 72,000
P-7b
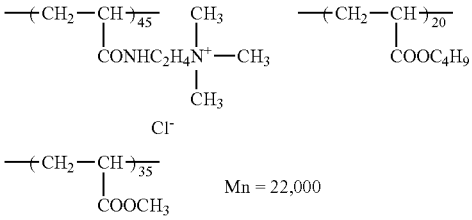
Mn = 22,000
P-8b
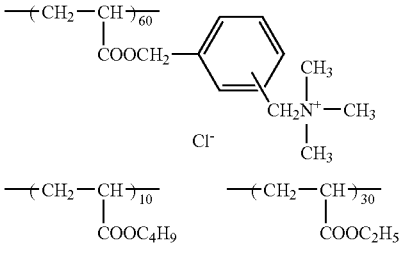
Mn =46,000
P-9b
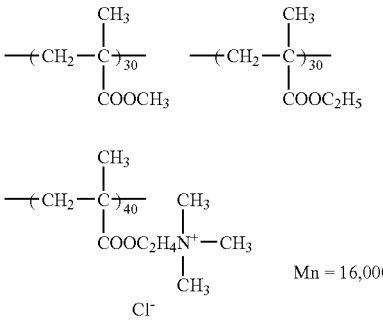
Mn = 16,000
P-10b
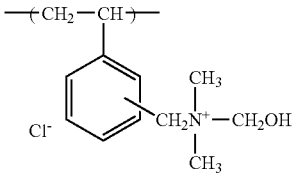
Mn = 36,000
-continued
P-11b
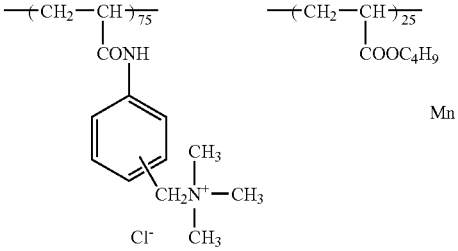
Mn = 56,000
P-12b
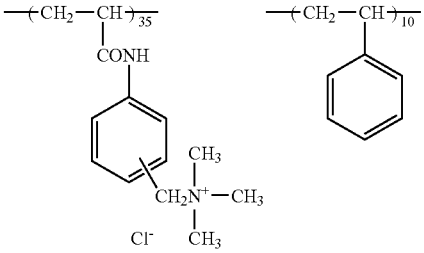
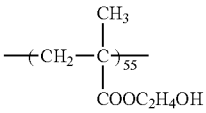
Mn = 32,000
P-13b
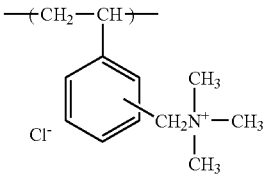
Mn = 24,000
P-14b
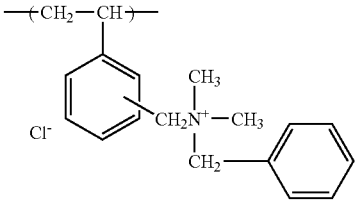
Mn = 19,000
P-15b
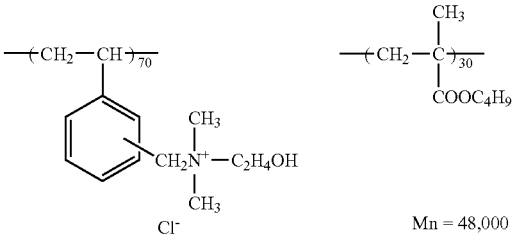
Mn = 48,000

-continued

P-16b

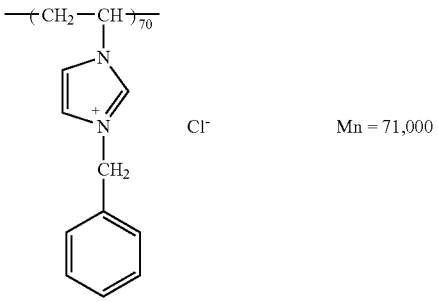

Mn = 71,000

P-17b

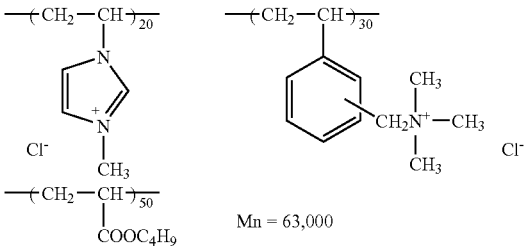

Mn = 63,000

Further, the ink-jet recording sheet of this invention preferably contains multivalent metal ions to improve water resistance of images and moisture resistance. The multivalent metal ions are not specifically restricted when they are at least divalent or higher, but listed are aluminum ions, zirconium ions or titanium ions.

These multivalent metal ions may be contained in an ink absorbing layer in the form of water soluble or non-water soluble salts. Listed as specific examples of aluminum atom containing salts which are suitable for the present invention are aluminum fluoride, hexafluoroaluminate (such as, potassium salts), aluminum chloride, basic aluminum chloride (such as, polyaluminum chloride), tetrachloroaluminate (such as, sodium salts), aluminum bromide, tetrabromoaluminate (such as, potassium salts), aluminum iodide, aluminate (such as, sodium salts, potassium salts, and calcium salts), aluminum chlorate, aluminum perchlorate, aluminum thiocyanate, aluminum sulfate, basic aluminum sulfate, aluminum potassium sulfate (alum), aluminum ammonium sulfate (ammonium alum), aluminum sodium sulfate, aluminum phosphate, aluminum nitrate, aluminum hydrogenphosphate, aluminum carbonate, aluminum silicate polysulfate, aluminum formate, aluminum acetate, aluminum lactate, aluminum oxalate, aluminum isopropionate, aluminum butyrate, ethyl acetate aluminum diisopropionate, aluminum tris(acetylacetonate), aluminum tris(ethylacetoacetate), and aluminum monoacetylacetonatebis (ethylacetoacetonate).

Of these, preferred are aluminum chloride, basic aluminum chloride, aluminum sulfate, basic aluminum sulfate, and basic aluminum silicate sulfate, while specifically preferred are basic aluminum chloride and basic aluminum sulfate.

Listed as specific examples of zirconium atom containing compounds are zirconium difluoride, zirconium trifluoride, zirconium tetrafluoride, hexafluorozirconate (such as, potassium salts), heptafluorozirconate (such as, sodium salts, potassium salts, and ammonium salts), octafluorozirconate (such as, lithium salts), zirconium fluoride oxide, zirconium dichloride, zirconium trichloride, zirconium tetrachloride, hexachlorozirconate (such as, sodium salts and potassium salts), zirconium oxychloride (zirconyl chloride), zirconium dibromide, zirconium tribromide, zirconium tetrabromide, zirconium bromide oxide, zirconium triiodide, zirconium tetraiodide, zirconium peroxide, zirconium hydroxide, zirconium sulfide, zirconium sulfate, zirconium p-toluenesulfonate, zirconyl sulfate, sodium zirconyl sulfate, acidic zirconyl sulfate trihydrate, potassium zirconium sulfate, zirconium selenate, zirconium nitrate, zirconyl nitrate, zirconium phosphate, zirconyl carbonate, ammonium zirconyl carbonate, zirconium acetate, zirconyl acetate, ammonium zirconyl acetate, zirconyl lactate, zirconyl citrate, zirconyl stearate, zirconyl phosphate, zirconium oxalate, zirconium isopropionate, zirconium butyrate, zirconium acetylacetonate, acetyl acetone zirconium butyrate, zirconium stearate butyrate, zirconium acetate, bis(acetylacetonato)dichlorozirconium, and tris(acetylacetonato)chlorozirconium.

Of these compounds, from the viewpoint of further providing significant bleeding prevention effects after printing, preferred are zirconyl carbonate, ammonium zirconyl carbonate, zirconyl acetate, zirconyl nitrate, zirconyl chloride, and zirconyl citrate.

These metal ion compounds may be used by themselves or in combinations of 2 or more kinds. Compounds containing multivalent metal ions may be added directly to a coating composition forming an ink absorbing layer, or provided to an ink absorbing layer with a overcoat method after a porous layer has been coated, specifically after a porous layer has been coated and dried. In cases when the compound containing multivalent metal ions is added to a coating composition as in the former example, employed is a method to add the compound uniformly dissolved in water, in an organic solvent or in a mixed solution of these, or to add the compound after dispersion to minute oil droplets employing a wet milling method using a sand mill, or an emulsifying dispersion method. In cases when the ink absorbing layer is comprised of a plurality of layers, the resulting solution or dispersion of the compound may be added to the coating composition of only one, some, or all of the constituting layers. Further, in cases when added in an overcoat method after a porous ink absorbing layer has been formed as in the latter example, it is preferable that the compound containing multivalent metal ions is provided to an ink absorbing layer after it has been uniformly dissolved in a solvent.

Multivalent metal ions may be generally incorporated in amounts of 0.05–20 mmol per $m^2$ of the recording sheet, and more preferably 0.1–10 mmol/$m^2$.

It is preferred to add a hardening agent to the ink-jet recording sheet, being a water soluble binder which forms the porous ink absorbing layer.

Usable hardening agents of the present invention are not limited as long as they cause a hardening reaction in a water soluble binder, and preferably used is boric acid and salts thereof, and in addition other commonly known compounds may be used. Generally, hardening agents are compounds having a group capable of reacting with a water soluble binder, or accelerating a reaction between different groups contained in the water soluble binder, and are appropriately used depending on the type of water soluble binder. Examples of hardening agents are epoxy type hardening agents (e.g., diglycidyl ethyl ether, ethylene glycol diglycidyl ether, 1,4-butanediol diglycidyl ether, 1,6-diglycidylcyclohexane, N,N-diglycidyl-4-glycidyloxyaniline, sorbitol polyglycidyl ether, and glycerol polyglycidyl ether); aldehyde type hardening agents (e.g., formaldehyde and glyoxal); active halogen type hardening agents (e.g., 2,4-dichloro-4-hydroxy-1,3,5-s-triazine); and active vinyl type compounds (e.g., 1,3,5-trisacryloyl-hexahydro-s-triazine, and bisvinylsulfonyl methyl ether); and aluminum alum.

Boric acid and salts thereof refer to oxygen acids having a boron atom as the central atom and salts thereof, and specifically listed are orthoboric acid, diboric acid, metaboric acid, tetraboric acid, pentaboric acid, and octaboric acid, and salts thereof.

Hardening agents of boric acid and salts thereof having a boron atom may be used in the form of a solution thereof, by itself or in a mixture of two or more kinds. Specifically preferred is a mixed solution of boric acid and borax.

Usually only a boric acid solution or a borax solution are added in relatively diluted solutions, but a denser solution can be obtained by mixing both solutions, resulting in a concentrated coating composition. Further, there is a benefit by adjusting the pH of the added solution to an optional level.

The total added amount of the foregoing hardening agents is preferably 1–600 mg/g of the foregoing water soluble binder. Further, the more preferred amount is 100–600 mg/g of the water soluble binder.

The light resistance enhancing agents usable in this invention are known as an anti-oxidizing agent, a light stabilizer, an ultraviolet absorbing agent, a radical scavenger, a singlet oxygen scavenger and an age resister in the fields of rubber, plastic and photography. Consequently, they are not specifically limited, but are preferably selected from the following (1)–(7).

Ultraviolet absorbing agents selected from:

(1) phenol derivatives, (2) sulfur containing compounds, (3) amine derivatives, (4) multivalent metal salts, (5) phosphor compounds, (6) monomeric alcohols, and (7) benzotriazole derivatives or benzophenone derivatives Light resistance enhancing agents of (1)–(7), will be described below.

Phenol derivatives are described in JP-A Nos. 2000-233655, 1-18684, 1-95091, 57-74192, 57-87989 and 64-36480, and specifically preferable phenol derivatives are so-called hindered phenol anti-oxidizing agents at least one of which ortho-positioned hydroxyl groups is substituted with a tertiary alkyl group, and hydroquinone diethers. Specific examples include Smilizer BHT, Sumilizer MDP-S, Sumilizer GM, Sumilizer BBM-S (produced by Sumitomo Chemical Co., Ltd.); Irganox 1076, Irganox 565, Irganox 1520, Irganox 245 (produced by Ciba Specialty Chemicals); Adekastab AO-80, Adekastab AO-23 (produced by ASAHI DENKA CO., LTD.); and 2,5-di(t)pentylhydroquinone-dioctyl ether.

Sulfur containing compounds are described in JP-A Nos. 61-177279, 61-163886, 64-36479, 7-314883, 7-314882, 1-115677, 8-25679, 10-330644 and 2001-270236. Preferable compounds are represented by following Formulas (1) or (2).

R—S—R' Formula (1)

wherein R and R' represent an alkyl group or an aryl group.

Formula (2)

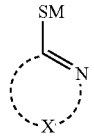

wherein X represents nonmetallic atom groups necessary to comprise a 5–7-membered ring, M represents a hydrogen atom, an ammonium ion or a metallic atom.

In Formula (1), alkyl groups represented by R and R' are substituted or unsubstituted alkyl groups, where the substituent groups include a hydroxyl group, an aryl group, an alkoxyl group, an alkylthio group, an arylthio group, an amino group, a mercapto group, a carboxyl group, a sulfo group, an acyl group, a carbamoyl group, a sulfamoyl group, or an hydrogen atom. Specific examples of compounds represented by Formula (1) are shown below.

(1-1) $HOC_2H_4SC_2H_4OH$ (1-2) $HOC_2H_4SC_2H_4SC_2H_4OH$ (1-3) $HOC_2H_4SC_2H_4SC_2H_4SC_2H_4OH$ (1-4) $C_4H_9COOC_2H_4SC_2H_4SC_2H_4OH$ (1-5) $C_4H_9COOC_2H_4SC_2H_4SC_2H_4OCOC_4H_9$ (1-6) $C_{12}H_{25}OCOC_2H_4SC_2H_4COOC_{12}H_{25}$ (1-7) $(C_4H_9SC_2H_4COOCH_2)_2S$ (1-8) $(C_{12}H_{25}SC_2H_4COOCH_2)_2S$ (1-9) $(HOOCCH_2CH_2)_2S$ (1-10) $(HOOCCH_2)_2S$ (1-11)

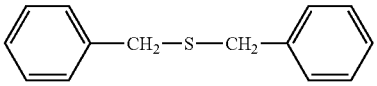

(1-12)

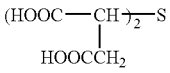

(1-13)

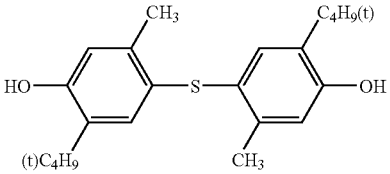

(1-14)

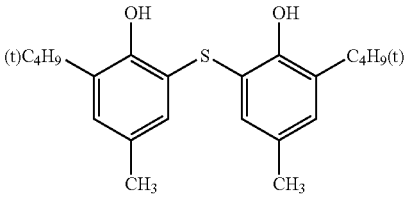

-continued (1-15)

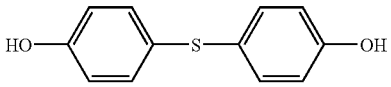

(1-16)

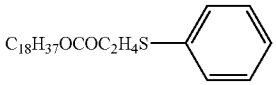

(1-17)

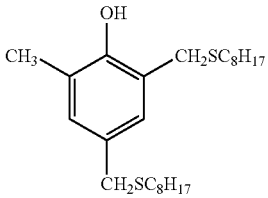

(1-18)

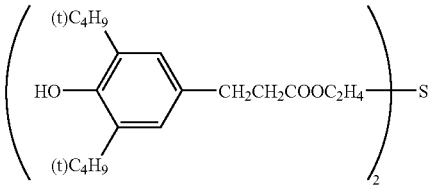

(1-19)

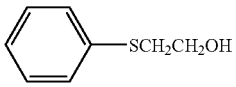

Of the above compounds, specifically preferable compounds are water-soluble thioether compounds, and further specifically preferable are the compounds having at least one water soluble group such as a hydroxyl group, or a carboxyl group.

In the compounds represented by Formula (2), a 5–7-membered ring consisted of nonmetallic atoms is preferably a 5-membered azole ring. Examples of azole rings include monocyclic compounds such as pyrol, pyrazole, imidazole, triazole, tetrazole, oxazole, thiazole, thiadiazole, celenazole, and telurazole; as well as condensed rings such as indole, indazole, purine, benzimidazole, benzotriazole, benzoxazole, benzothiazole, naphthoimidazole, and naphthothiazole. Listed further, as preferable compounds are 6-membered rings such as pyridine, pyrimidine, pyrazine, pyridazine, and s-triazine; their condensed rings such as quinoline, isoquinoline, phthalazine, quinoxaline, and quinazoline; as well as 7-membered rings such as azepine and benzodiazepine.

Further, these rings may be substituted, where the substituent groups include an alkyl group, an alkenyl group, an aryl group, an alkoxyl group, an aryloxy group, an alkylthio group, an arylthio group, a hydroxyl group, an amino group, a mercapto group, a carboxyl group, an acyl group, a carbamoyl group, a sulfamoyl group, a halogen atom and a cyano group. These substituent group may be further substituted.

Specific examples of the compounds represented by Formula (2) are shown below.

(2-1)

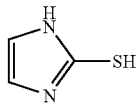

(2-2)

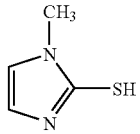

(2-3)

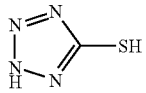

(2-4)

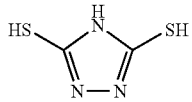

(2-5)

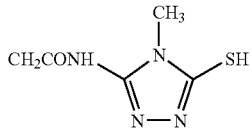

(2-6)

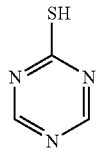

(2-7)

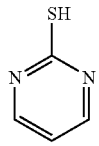

(2-8)

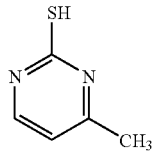

(2-9)

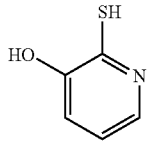

(2-10)

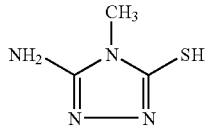

(2-11)

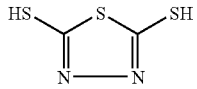

-continued (2-12)

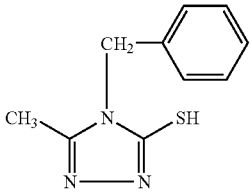

(2-13)

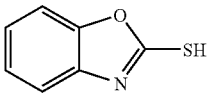

(2-14)

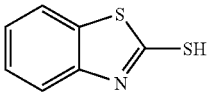

(2-15)

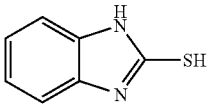

(2-16)

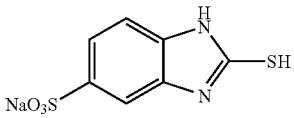

(2-17)

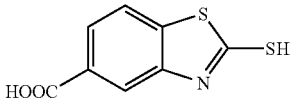

(2-18)

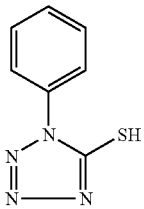

(2-19)

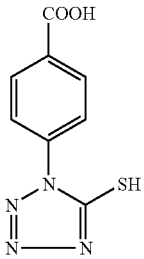

(2-20)

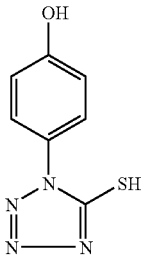

-continued (2-21)

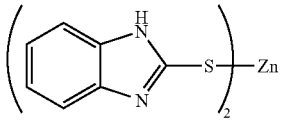

(2-22)

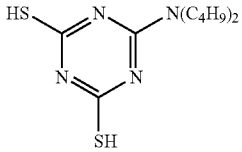

Amine derivatives are described in JP-A Nos. 2000-263918, 2001-139851, 2001-341418, 2002-19267, 2001-191640, 2000-271499, 62-37181, 62-37182, 62-37183, 61-164989, 59-96987 and 61-146591. Listed as specifically preferable amine derivatives, are hindered amines typified by 2,2,6,6-tetramethylpiperidine having a 4-position substituent group, and also hydroxyamines and water soluble aliphatic tertiary amines. Specifically listed are, Adekastab LA-52 (produced by ASAHI DENKA CO., LTD.), SYASORB UV-3346 (produced by Cytec Industries, Inc.), Sumisorb 577 (produced by Sumitomo Chemical Co., Ltd.), N,N-bissulfoethylhydroxyl amine, and triethanol amine.

Multivalent metal salts are described in JP-A Nos. 7-149037, 61-43593, 55-53591, 56-86789, 58-94491, 59-155088, 59-96988, 60-46288, 60-67190, 60-189480, 61-10484, 61-57379, 8-25794, 4-7189, 8-118788, 9-176995, 11-321099, 10-226153, 2001-130126, 2001-138622, 2001-238340, 2001-334742 and 2002-103786. As specifically preferable metal salts, listed are salts containing cesium, magnesium, aluminum and zirconium.

Phosphor compounds are described in JP-A Nos. 57-74192, 8-118791 and 1-95091. As specifically preferable phosphor compounds, listed are HCA produced by SANKO CO., LTD.), Sumilizer TNP (produced by Sumitomo Chemical Co., Ltd.), and Adekastab HP-10 (ASAHI DENKA CO., LTD.).

Alcohols selected from moromeric alcohols, monosaccharides and origosaccharides, are described in JP-A 7-276790. As specifically preferable alcohols, listed are ascorbic acid, erythorbic acid, glucose, cyclodextrin and branched cyclodextrin.

Ultraviolet absorbing agents selected from benzotriazole derivatives and benzophenone derivatives are described in JP-A Nos. 57-74193, 57-87988, 11-99740, 10-235992, 11-254812, 11-292612, 11-314451, 2000-141875, 2001-287349, 2001-138625, 2002-19273 and 2002-19275. Specifically, benzotriazole ultraviolet absorbing agents are preferable.

White background adjusting agents used in this invention are fluorescent brightening agents added for showing white background as a brighter white, and colorants such as dyes and pigments to adjust tint in accordance with the targeted purpose such as paper for printing. As a white background adjusting agent added to highly transparent porous ink absorbing layer having fine porous voids, it is preferable to use a fluorescent brightening agent or a dye which does not impair transparency nor glossiness.

However, since these white background adjusting agents tend to be easily deactivated or discolored by oxidizing gases, white backgrounds controlled by using a fluorescent brightening agent or a colorant result in having a great tendency for discoloration over time. Consequently, as in this invention, in cases when the colorant is employed with a compound having a plurality of non-aromatic carbon-carbon unsaturated bonds in the molecule to prevent deactivation by oxidizing gases, the color fluctuation range of white background is small, and the effect for the white background adjusting agent is exhibited markedly. Specifically, in cases when a fluorescent brightening agent is employed, unnecessary coloration with other additives added to the ink receiving layer may be corrected due to emission by absorption of near ultraviolet rays by the fluorescent agent itself, leading it to be generally employed to show a brilliant white background. In cases when the fluorescent brightening agent is deactivated with oxidizing gases, it may be not colored, resulting in it sometimes exhibiting only absorption in the blue color region. As a result, the color fluctuation range of these white backgrounds may be greater than that of cases using other colorants or not at all using a fluorescent brightening agent.

In the embodiment of this invention to prevent deactivation of a fluorescent brightening agent by oxidizing gases using with the compound having a plurality of non-aromatic carbon-carbon unsaturated bonds in the molecule, the current inventors discovered characteristics of a small color fluctuation range of white background and of the possibility to exhibit the effect for a white background adjusting agent, even in cases when a fluorescent brightening agent is employed.

As usable fluorescent brightening agents in this invention, listed , for example, are coumarin derivatives, stilvene derivatives, pyrene derivatives, oxazole derivatives, thiazole derivatives, imidazole derivatives, imidazolone derivatives, and pyrazoline derivatives. These fluorescent brightening agents are available on the market under the product names of the Uvitex series and the Tinopal series from Ciba Specialty Chemicals, the Kayacoll series from Nippon Soda Co., Ltd., the Whitex series from Sumitomo Chemical CO., Ltd., the Kayaphor series from Nippon Kayaku Co., Ltd., and the Blankophor series from Bayer AG.

In cases when these fluorescent brightening agents are water soluble dyes, they may be anionic or cationic depending on the kind of the water soluble substituent group, both of which may be used. Also, oil soluble dyes may be used in a dispersion. From the viewpoint of fluorescence intensity and tint, stilvene type fluorescent brightening agents are preferred.

As usable colorants in this invention, either the dye type or pigment type colorants may be employed. As added colorants, the colorants known in the art may be employed, such as an azo type, a quinone type, a quinoneimine type, indigo type, a diphenylmethane type, and a triphenylmethane type.

Supports usable in the present invention are those common for ink-jet recording sheets, and employed as appropriate. A water absorptive support may be employed, but a non-water absorptive support is preferably employed.

As the water absorptive support usable in this invention, common paper supports, cloth and wood supports of sheets or card stock may be listed. Specifically, paper supports are preferably used because of their high water absorption and low cost as a base material. Raw material used for a paper support may be mainly wood pulp containing chemical pulp such as LBKP and NBKP, mechanical pulp such as GP, CGP, RMP, TMP, CTMP, CMP, and PGW, recycled paper pulp such as DIP. If necessary, various kinds of fibrous material such as synthetic pulp, synthetic fibers or inorganic fibers may also be used as a raw material.

It is also acceptable to add conventionally known additives to the paper support. Such additives include sizing agents, pigments, paper-strengthening agents, fixing agents, fluorescent brightening agents, wet strength enhancing agents, and cationizing agents.

These paper supports can be manufactured employing conventional paper making equipment such as a Fourdrinier paper machine, a cylinder paper machine, and a twin wire paper machine after applying several kinds of additives to the above-listed fibers, such as wood pulp. The paper support may be size-pressed with starch or polyvinyl alcohol during or after manufacture, as required. Several types of coatings or calendering treatments may also be conducted.

Preferably used non-water absorptive supports in the present invention may be either transparent or opaque supports. Transparent supports include film containing resins such as polyester type resin, diacetate type resin, triacetate type resin, acryl type resin, polycarbonate type resin, polyvinyl chloride type resin, polyimide type resin, cellophane and Celluloid. Among other factors, a support exhibiting the property to resist radiation heat, as when used in an overhead projector is preferably used, for which polyethylene terephthalate is specifically preferable. The thickness of these transparent supports is preferably 50–200 μm.

Further, preferable opaque supports are, for example, a resin coated paper having a polyolefin coated layer containing white pigments on at least one side of the paper base (commonly called RC paper), and what is known as white PET, comprising polyethylene terephthalate added white pigments, such as barium sulfate.

It is preferable that the supports be subjected to a corona discharge treatment or a subbing layer treatment, before coating of a porous layer, in order to enhance the adhesive force between the foregoing supports and the ink absorbing layer. Further, the ink-jet recording sheet of the present invention is not necessarily colorless, but may be colored.

For the ink-jet recording sheet of the present invention, paper supports laminated on both sides of the paper base with polyethylene are preferable, because the resulting recorded image is closer in quality to conventional photography, and furthermore, such high image quality is obtained at a relatively low cost. Polyethylene laminated paper supports will be described below.

Paper employed in the supports is made by employing wood pulp as the main raw material, and alternatively, synthetic pulp such as polypropylene or synthetic fiber such as nylon and polyester. Employed as the wood pulp may be any of LBKP, LBSP, NBKP, NBSP, LDP, NDP, LUKP, and NUKP. However, it is preferable that LBKP, NBSP, LBSP, NDP, and LDP comprising short fiber component in a relatively large amount are employed. Incidentally, the ratio of LBSP and/or LDP is preferably 10–70 weight %.

Preferably employed as the foregoing pulp is chemical pulp (sulfate pulp and sulfite pulp) comprising minimal impurities. Further, also useful is pulp which has been subjected to a bleaching treatment to enhance whiteness.

Suitably incorporated into the paper base may be sizing agents such as higher fatty acids and alkylketene dimers; white pigments such as calcium carbonate, talc, and titanium oxide; paper strength enhancing agents such as starch, polyacrylamide, and polyvinyl alcohol; fluorescent brightening agents; moisture retention agents such as polyethylene glycols; dispersing agents; and softeners such as quaternary ammonium.

The degree of water freeness of pulp employed for paper making is preferably between 200 and 500 ml based on CSF Specification. Further, the sum of the weight % of 24-mesh residue and the weight % of 42-mesh residue regarding the fiber length after beating, specified in JIS-P-8207, is preferably 30–70%. Further, the weight % of 4-mesh residue is preferably not more than 20 weight %.

The basis weight of the paper base is preferably 50–250 g, and is specifically preferably 50–200 g. The thickness of the paper base is preferably 40–250 μm.

During the paper making stage, or alternatively after paper making, the paper base may be subjected to a calendering treatment to achieve excellent smoothness. The density of the paper base is generally 0.7–1.2 g/m$^3$ (JIS-P8118). Further, the stiffness of the paper base is preferably 20–200 g under the conditions specified in JIS-P-8143.

Surface sizing agents may be applied onto the paper base surface. As surface sizing agents, the foregoing sizing agents capable being added to the paper base may be employed.

The pH of the paper base, when determined employing a hot water extraction method specified in JIS-P-8113, is preferably 5–9.

Polyethylene, which covers both surfaces of the paper, is comprised mainly of low density polyethylene (LDPE) or high density polyethylene (HDPE), but it is also possible to employ small amounts of LLDPE and polypropylene.

Specifically, rutile or anatase type titanium oxide is preferably incorporated into the polyethylene layer on the ink absorbing layer side which tend to improve opacity and whiteness, as widely conducted in photographic print paper production. The content ratio of titanium oxide is commonly 3–20 weight % with respect to the polyethylene, and is preferably 4–13 weight %.

Polyethylene coated paper may be used in this invention as a glossy paper, or a matte surface or silk surface paper, formed under so-called embossing, during melt extrusion coating of the polyethylene onto the paper base, again as is commonly conducted in photographic print paper production.

The water content of the paper base of the foregoing polyethylene coated paper is preferably maintained in the 3–10 weight % range.

Various types of additives may be incorporated into the ink-jet recording sheet of this invention. For example, the following various additives, commonly known in the art, may be incorporated: such as, polystyrene, polyacrylic acid esters, polymethacrylic acid esters, polyacrylamides, polyethylene, polypropylene, polyvinyl chloride, polyvinylidene chloride, or copolymers thereof; minute organic latex particles of urea resins or melamine resins; various types of surface active agents; UV absorbing agents described in JP-A Nos. 57-74193, 57-87988, and 62-261476; anti-discoloration agents described in JP-A Nos. 57-74192, 57-87989, 60-72785, 61-146591, 1-95091, and 3-13376; fluorescent brightening agents described in JP-A Nos. 59-42993, 59-52689, 62-280069, 61-242871, and 4-219266; pH adjusting agents such as sulfuric acid, phosphoric acid, citric acid, sodium hydroxide, potassium hydroxide, and potassium carbonate; and antifoaming agents, antiseptics, viscosity thickening agents, antistatic agents, and matting agents.

The surface active agents preferably used in this invention are various types of anionic, cationic, nonionic or betaine type surface active agents, but betain type surface active agents are specifically preferred due to significant reduction of cracking during coating.

The compounds represented by the following formulas are listed as examples of anionic, betain and cationic type surface active agents preferably used in this invention.

$$R^1\text{—}(X\text{-}L)_p\text{-}COOM \qquad \text{Formula (1)}$$

wherein $R^1$ represents an aliphatic group (for example, a saturated or unsaturated, substituted or non-substituted, straight chain or branched alkyl group); X represents—CON($R^2$)—, —$SO_2N(R^3)$—; $R^2$ and $R^3$ represent a hydrogen atom or a group defined in $R^1$; $_p$ represents 0 or 1; M represents a hydrogen atom, an alkaline metal (Na, K), an ammonium ion or an organic ammonium ion; and L represents an alkylene group.

$$R^1\text{—}(X\text{-}L)_p\text{-}(Y)_{m3}SO_3M \qquad \text{Formula (2)}$$

wherein $R^1$ represents an aliphatic group (for example, a saturated or unsaturated, substituted or non-substituted, straight chain or branched alkyl group); X represents—CON($R^2$)—, —$SO_2N(R^3)$—, —COO—; $R^2$ and $R^3$ represent a hydrogen atom or a group defined in $R^1$; $_p$ and $_{m3}$ are each 0 or 1; L represents an alkylene group; Y represents an oxygen atom; and M represents an alkaline metal (e.g., Na, K, Li).

$$A_2\text{-}O\text{—}(CH_2CH_2O)_n\text{—}SO_3M \qquad \text{Formula (3)}$$

wherein M represents an alkaline metal (e.g., Na, K, Li); n is 1–100; $A_2$ is a monovalent organic group, for example, an alkyl group having a carbon number of 6–20, preferably 6–12 (such as, a group of hexyl, heptyl, octyl, nonyl, decyl, undecyl or dodecyl), or an allyl group substituted with an alkyl group having the carbon number of 3–20, in which the substituted group preferably having 3–12 carbons is an alkyl group (such as, each group of propyl, butyl, pentyl, hexyl, heptyl, octyl, nonyl, decyl, undecyl or dodecyl), and listed as allyl groups are phenyl, tolyl, xynyl, biphenyl or naphtyl group, but preferable is a phenyl group or a tolyl group, and the position of an allyl group bonded with an alkyl group may be any of an ortho-, meta- or para-position.

Formula (4)

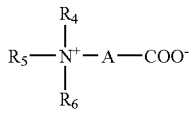

Wherein $R_4$, $R_5$ and $R_6$ are each a substituted or unsubstituted alkyl group, $R_4$ and $R_5$ or $R_5$ and $R_6$ may each form a ring; "A" represents —$(CH)_n$— ("$_n$" represents an integer of 1–3).

Formula (5)

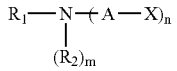

wherein $R_1$ is the same as $A_2$ in foregoing Formula (3); $R_2$ represents a hydrogen atom or an alkyl group (such as a methyl group or ethyl group); m and n are each 0, 1 or 2; A is an alkyl group or a substituted or unsubstituted allyl group; X is —COOM or —$SO_3M$; and M represents a hydrogen atom or an alkaline metal.

Formula (6)

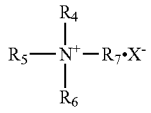

wherein $R_4$, $R_5$, $R_6$, and $R_7$ each represents a hydrogen atom, a substituted or unsubstituted alkyl group, or a phenyl group; $X^-$ represents an anion such as a halogen atom, a hydroxyl group, a sulfonic acid group, a carboxilic acid group, a nitric acid group, an acetic acid group, or a p-toluene sulfonic acid group.

Formula (7)

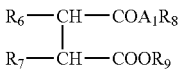

wherein either $R_6$ and $R_7$ represents a hydrogen atom or an alkyl group, and the other represents a group represented by formula —$SO_3M$ (wherein M represents a hydrogen atom or a monovalent cation); $A_1$ represents an oxygen atom or a group represented by —N(—$R_{10}$)—, and $R_{10}$ represents a hydrogen atom or an alkyl group having 1–8 carbons; $R_8$ and $R_9$ each represents an alkyl group having 4–30 carbons; however, an alkyl group represented by $R_8$, $R_9$ or $R_{10}$ may be substituted with a fluorine atom.

Formula (8)

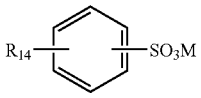

Formula (9)

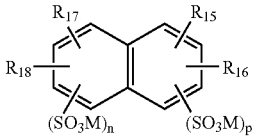

wherein $R_{14}$, $R_{15}$, $R_{16}$, $R_{17}$ and $R_{18}$ each represents a hydrogen atom or an alkyl group; M is the same as in foregoing formula (2); n and p are each 0 or an integer of 1–4, and a value satisfying $1 \leqq n+p \leqq 8$.

Listed below are exemplary compounds, which are represented by Formulas (1) through (9), but are not limited to these examples.

The examples represented by Formula (1) are shown below.

1-1 $C_{12}H_{25}$—$SO_2NHCH_2CH_2COONa$ 1-2 $C_{12}H_{25}COONa$ 1-3 $C_{13}H_{27}COOK$ 1-4 $C_{17}H_{33}CONHCH_2CH_2COONa$ 1-5 $C_{17}H_{33}CON(CH_3)$—$CH_2COONa$ 1-6 $C_{17}H_{33}CON(CH_3)$—$CH_2COOH$

The examples represented by Formula (2) are shown below.

2-1 $C_{12}H_{25}SO_3Na$ 2-2 $C_{11}H_{23}CONHCH_2CH_2OSO_3Na$ 2-3 $C_{12}H_{25}CONH$—$(CH_2CH_2O)_n$—$CH_2CH_2OSO_3Na$ 2-4 $C_{12}H_{25}OSO_3Na$ 2-5 $C_{11}H_{23}COOCH(OH)CH_2OSO_3Na$ 2-6 $C_{11}H_{23}CON(CH_3)$—$CH_2CH_2SO_3Na$ 2-7 $C_{15}H_{31}CON(CH_2CH_2OH)$—$CH_2CH_2SO_3Na$ 2-8 $C_{17}H_{35}CON$—$CH_2CH_2SO_3Na$

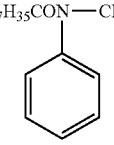

2-9 $C_{17}H_{35}CON(C_4H_9)$—$CH_2CH_2SO_3K$ 2-10 $C_{11}H_{23}CON(CH_3)$—$CH_2SO_3Na$ 2-11 $C_{15}H_{31}CON(CH_3)$—$CH_2CH_2SO_3Na$

The examples represented by Formula (3) are shown below.

3-1 $C_9H_{19}O(C_2H_4O)_4SO_3Na$ 3-2 $C_{10}H_{21}O(C_2H_4O)_{15}SO_3Na$ 3-3

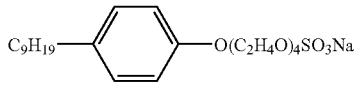

3-4

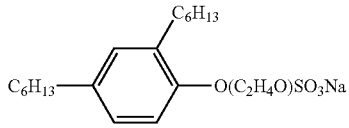

3-5

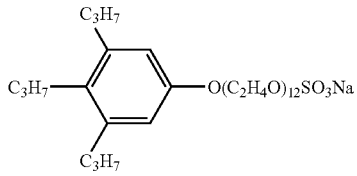

3-6

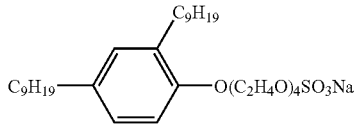

3-7 $C_{12}H_{25}O(C_2H_4O)_4SO_3Na$

The examples represented by Formula (4) are shown below.
4-1
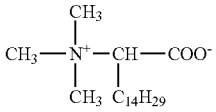
4-2
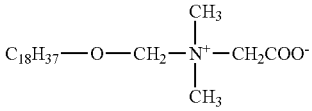
4-3
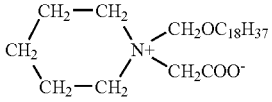
4-4
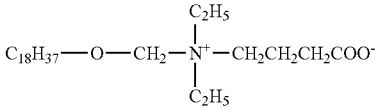
4-5
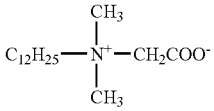
4-6
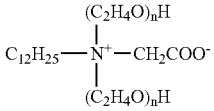
The examples represented by Formula (5) are shown below.
5-1
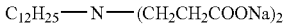
5-2
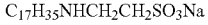
5-3
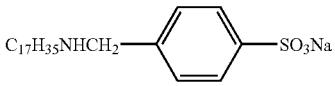
The examples represented by Formula (6) are shown below.
6-1
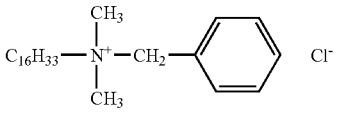
6-2
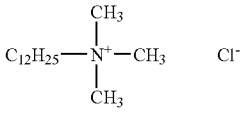
-continued
6-3
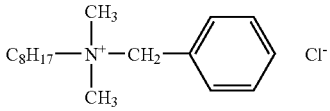
6-4
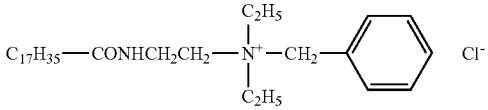
6-5
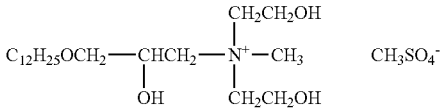
6-6
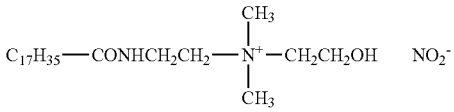
6-7
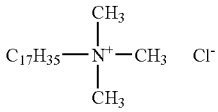
6-8
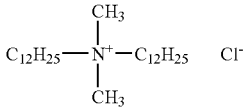
6-9
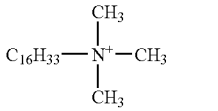
6-10
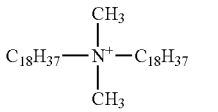
6-11
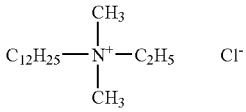
6-12
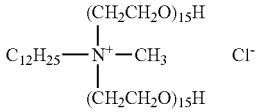
6-13
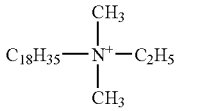

-continued
6-14
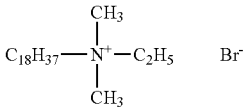
6-15
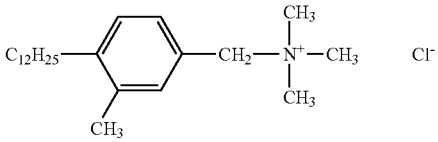
6-16
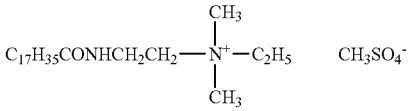
6-17
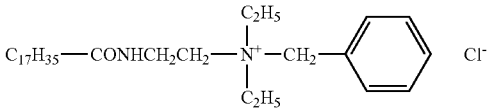
6-18
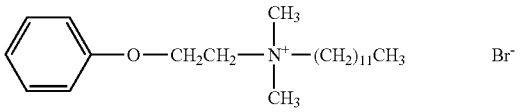
6-19
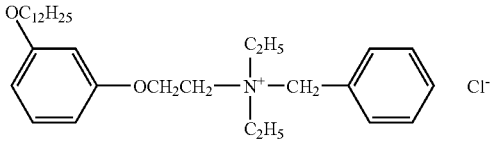
6-20
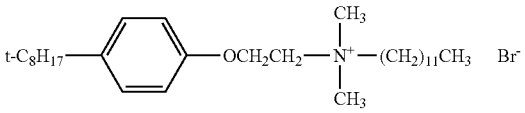
6-21
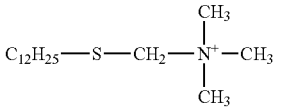
6-22
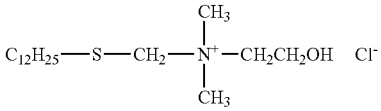
6-23
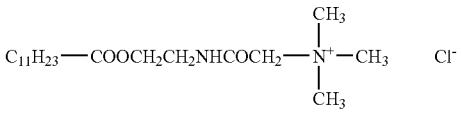
6-24
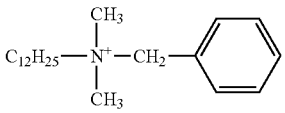
-continued
6-25
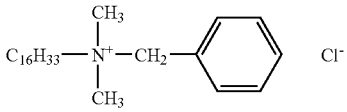
6-26
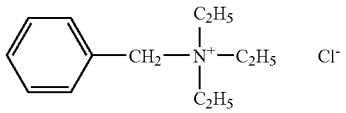
6-27
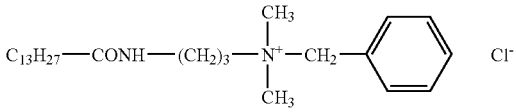
The examples represented by Formula (7) are shown below.
7-1
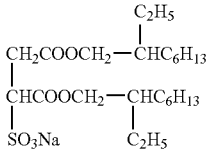
7-2
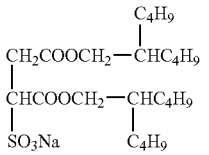
7-3
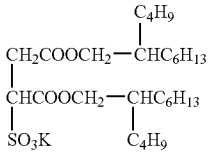
7-4
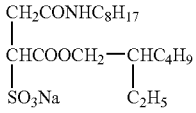
7-5
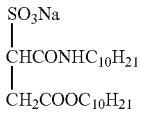
7-6
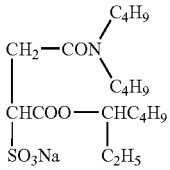

-continued
7-7
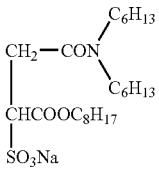
7-8
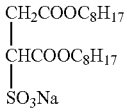
7-9
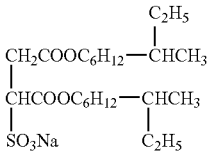
7-10
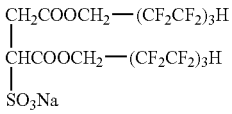
7-11
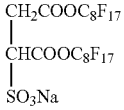
7-12
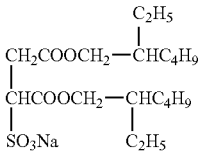
7-13
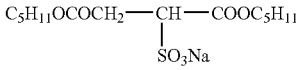
7-14
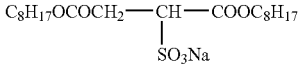
7-15
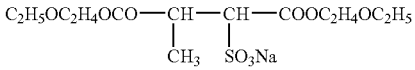
7-16
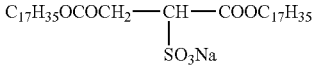
7-17
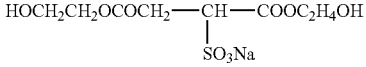
The examples represented by Formula (8) are shown below.
8-1
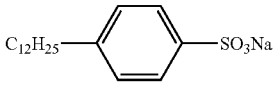
-continued
8-2
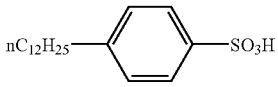
The examples represented by Formula (9) are shown below.
9-1
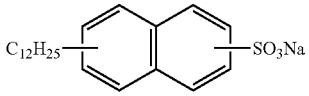
9-2
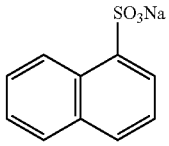
9-3
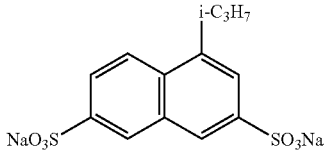
9-4
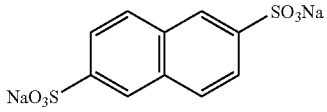
9-5
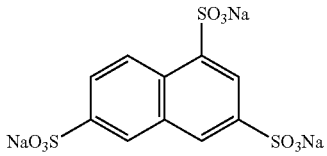
9-6
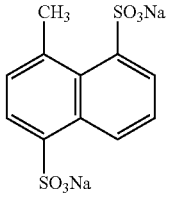
9-7
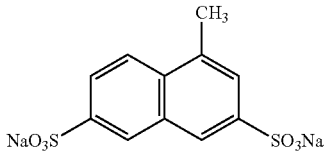
9-8
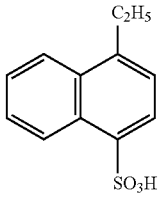

-continued 9-9

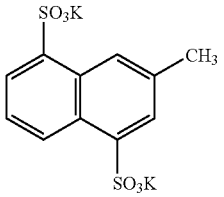

9-10

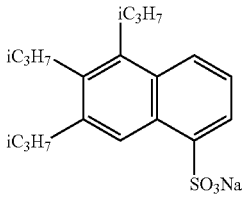

9-11

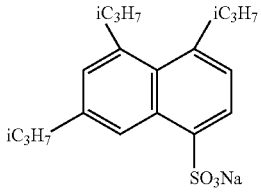

The surface active agents preferably used in this invention include a carboxybetaine type and a sulfobetaine type, while of these, a carboxybetaine type is preferable, but more preferable are carboxybetaine type fluorinated surface active agents.

Examples of betaine type fluorinated surface active agents preferably used in this invention are shown below, but this invention is not limited to these examples.

AH-1

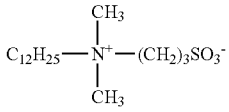

AH-2

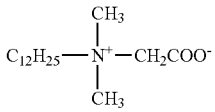

AH-3

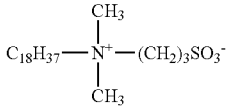

AH-4

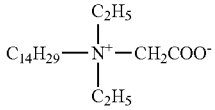

AH-5

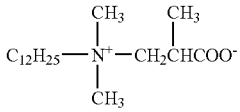

AH-6

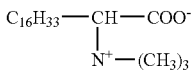

-continued

AH-7

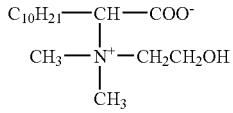

AH-8

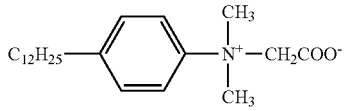

AH-9

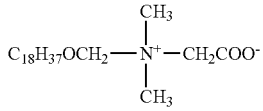

AH-10

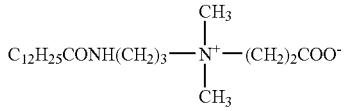

AH-11

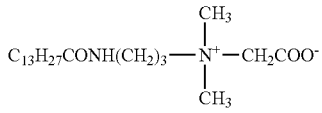

AH-12

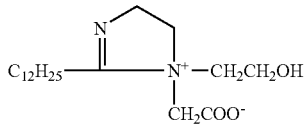

AH-13

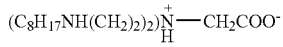

AH-14

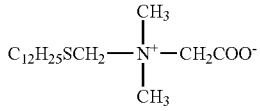

AH-15

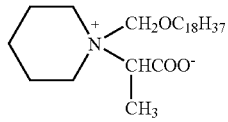

AH-16

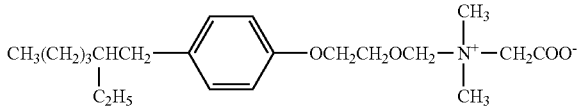

AH-17

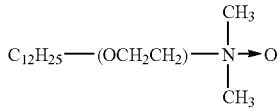

AH-18

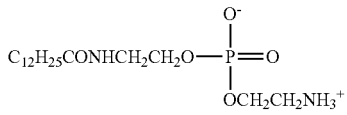

AH-19

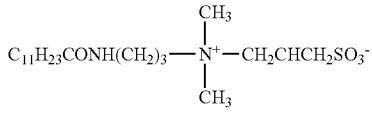

-continued

AH-20

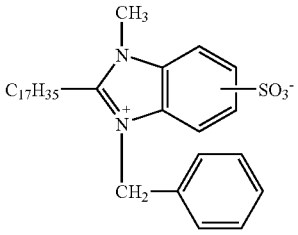

AF-1

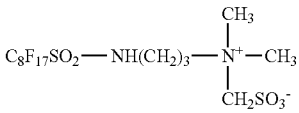

AF-2

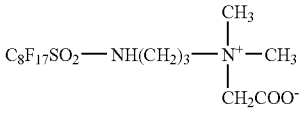

AF-3

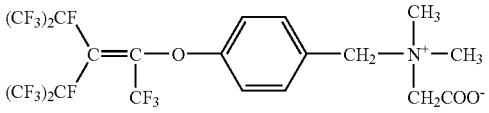

AF-4

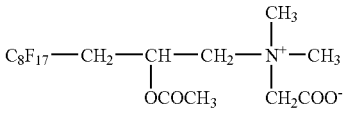

AF-5

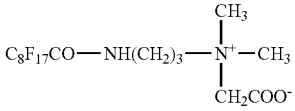

Betaine type surface active agents are preferably added to the coating composition forming the outermost ink absorbing layer, especially in cases when the coating compositions for forming these plural ink absorbing layers are coated on a support. The coated amount is commonly 0.01–1,000 mg/m$^2$, and preferably 1–100 mg/m$^2$.

In this invention, it is preferable to employ a nonionic type surface active agent in combination with the foregoing betaine type surface active agent.

Examples of nonionic type surface active agents include compounds represented by Formulas (I) or (II) as described in JP-A 3-223757, in which saponin or an acetylene glycol derivative is preferably employed.

The added amount of the surface active agents is 0.0001–1.0 g per m$^2$ of the ink-jet recording sheet, and preferably 0.001–0.5 g.

Antimicrobial agents (or anti-fungus agent) preferably used in this invention will now be described. The added amount of antimicrobial agents is not restricted, but to maximize the anti-discoloration effect, it is preferable to add $1.0\times10^{-7-5.0\times10-6}$ g per m$^2$ of the recording sheet. Employed as an adding method may be any conventional method to add to the coating composition, or to add to the emulsion solution such agent as an emulsified resin or an oil emulsion. The latter is preferable due to the resulting stability of the emulsion solution.

Various antimicrobial agents d commercially available from many manufacturers may be employed, and of these, compounds represented by following Formulas (11) or (12), polyhexamethylenebiguanidine hydrochloride or 2,2-dibromo-3-nitrilopropionamide are preferable, and more than two of them may be used in combination.

Formula (11)

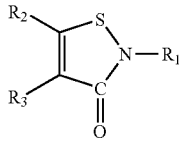

wherein $R_1$ represents a hydrogen atom, an alkyl group, an alkenyl group, an allyl group, a heterocyclic group, —$CONR_4(R_5)$, or =$CSNR_4(R_5)$; $R_2$ and $R_3$ each represents a hydrogen atom, an alkyl group, an allyl group, a cyano group, a heterocyclic group, an alkylthio group, an alkylsulfoxy group, or an alkylsulfonyl group; while $R_4$ and $R_5$ each represents a hydrogen atom, an alkyl group, an allyl group, or an aralkyl group.

Formula (12)

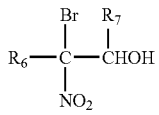

wherein $R_6$ represents a hydrogen atom, an alkyl group, or a hydrokymethyl group; and $R_7$ represents a hydrogen atom or an alkyl group.

As manufacturing methods of the ink-jet recording media of this invention, it is possible to employ a suitable method selected from those known in the art, by applying each constituting layer including the ink absorbing layer, which is provided sequentially or simultaneously with other layers, onto a support, and subsequently dried. Preferably employed as coating methods may be a roll coating method, a rod bar coating method, an air knife coating method, a spray coating method, a curtain coating method, an extrusion coating method, and a slide bead coating method employing a hopper, described in U.S. Pat. Nos. 2,761,419 and 2,761,791.

In cases when a slide bead coating method is employed, the viscosity of each coating composition during simultaneous multi-layer coating is preferably in the range of 5–100 mPa·s, and more preferably 10–50 mPa·s. Further, in cases when a curtain coating method is employed, it is preferable to be in the range of 5–1,200 mPa·s, and specifically preferably 25–500 mPa·s.

Further, viscosity of the coating composition at 15° C. is preferably more than 100 mPa·s, more preferably in the range of 100–30,000 mPa·s, still more preferably 3,000–30,000 mPa·s, further still more preferably 10,000–30,000 mPa·s.

As a coating and drying method, after warming the coating composition to at least 30° C. to conduct a simultaneous multi-layer coating, it is preferable to cool it down once to 1–15° C. to be followed by drying at 10° C. or more. During the preparation, coating and drying of the coating compositions, it is preferable to conduct said preparation, coating and drying of the coating compositions at a temperature lower than the Tg of the thermoplastics resins contained in the surface layer so that the thermoplastics resin does not film. More preferably, drying is conducted under conditions of at a wet bulb temperature of 5–50° C. and a film surface temperature in the range of 10–50° C. Further, the cooling method immediately after coating is preferably conducted with a flat setting method from the viewpoint of uniformity of the formed film layer.

Further, it is preferable to provide storage under conditions of at least 35° C. and less than 70° C. between 1–60 days during the production process.

The mentioned warming conditions are not specifically limited, if the storage conditions are between 35–70° C. for 1–60 days and preferable conditions are, for example, 36° C. for 3 days–4 weeks, 40° C. for 2 days–2 weeks, or 55° C. for 1–7 days. While conducting this heating treatment, the hardening reaction or crystallization in a water soluble binder is accelerated, resulting in achievement of the desired ink absorbability.

The ink-jet recording sheet of this invention specifically exhibits a large degree of the desired effect in ink-jet recording using water soluble dye ink, but is also usable in ink-jet recording using pigment ink.

In cases when image recording is conducted using the ink-jet recording sheet of this invention, a water based ink recording method is preferably employed.

The foregoing water based ink means a recording liquid solution containing a coloring agent and a solvent, described both below, and other additives. Employed as the coloring agents may be direct dyes, acidic dyes, basic dyes, reactive dyes, water-soluble food dyes, or water-dispersible pigments, which are commonly known in the art of ink-jet printing.

Listed as solvents of the water based ink are water and various water soluble organic solvents, including, for example, alcohols such as methyl alcohol, isopropyl alcohol, butyl alcohol, tert-butyl alcohol, and isobutyl alcohol; amides such as dimethylformamide and dimethylacetamide; ketones or ketone alcohols such as acetone and diacetone alcohol; ethers such as tetrahydrofuran and dioxane; polyalkylene glycols such as polyethylene glycol and polypropylene glycol; polyhydric alcohols such as ethylene glycol, propylene glycol, butylene glycol, triethylene glycol, 1,2,6-hexanetriol, thioglycol, hexylene glycol, diethylene glycol, glycerin, and triethanolamine; and lower alkyl ethers of polyhydric alcohols such as ethylene glycol methyl ether, diethylene glycol methyl (or ethyl) ether, and triethylene glycol monobutyl ether. Of these, preferred are polyhydric alcohols such as diethylene glycol, triethanolamine and glycerin, and lower alkyl ethers of polyhydric alcohols such as triethylene glycol monobutyl ether.

Listed as other water based ink additives are, for example, pH adjusting agents, metal sequestering agents, biocides, viscosity adjusting agents, surface tension controlling agents, wetting agents, surface active agents, and rust inhibiting agents.

In order to improve the wettability of the water based ink to the recording sheet, the water based ink generally exhibits a surface tension in the range of 0.025–0.060 N/m at 20° C., and preferably in the range of 0.03–0.05 N/m. The pH of the foregoing ink is preferably 5–10, and specifically preferably 6–9.

EXAMPLES

The present invention will be further explained based on examples in the following paragraphs, but it is not limited to these examples. "%" in the examples indicates weight % unless otherwise noted.

Example 1

Preparation of Ink-jet Recording Sheet

Preparation of Dispersion Solution

Preparation of Silica Dispersion Solution (A-1)

To 400 L of 25% silica dispersion solution (produced by Nippon Aerosil Co., Ltd.; Aerosil 200, with a primary particle diameter of 12 nm), emulsified uniformly in advance and adjusted to a pH of 2.8, added were 50 L of 20% aqueous solution of cationic polymer (P-1) and 60 L of aqueous solution dissolved in 1.7 g of boric acid and 1.7 g of borax, and the resulting mixture was dispersed with a high pressure homogenizer manufactured by Sanwa Industries Co., Ltd., after which the total amount was brought to 530 L with water to obtain Silica Dispersion Solution (A-1).

Cationic Polymer P-1

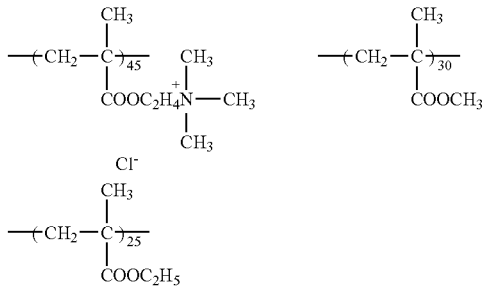

Preparation of Alumina Dispersion Solution (A-2)

To pure water adjusted to a pH of 3.0, a gas phase method alumina (produced by Degussa-Huels AG.; aluminum oxide C, at a primary particle diameter of 13 nm) was dispersed to obtain a 20% alumina content of Almina Dispersion Solution (A-2).

Preparation of Oil Dispersion Solution (B-1)

Additives described below were mixed and dispersed with a high pressure homogenizer, and the total amount was brought to 25 L with water to obtain Oil Dispersion Solution (B-1).

| | |
|---|---|
| Polybutadiene (produced by NIPPON SODA CO., LTD.; B-1000) | 8 kg |
| Polyvinyl alcohol (produced by Kuraray Co., Ltd.; PVA 203) (a 10% solution) | 11 kg |
| Saponin (a 20% solution) | 1.5 kg |

Preparation of Oil Dispersion Solution (B-2)

Solution A and Solution B described below, were each heated for faster dissolution, and after Solution A and Solution B were mixed at 55° C., the mixture was emulsified for dispersion with a high pressure homogenizer. The total amount of the resulting mixture was brought to 50 L with water to obtain Oil Dispersion Solution (B-2).

| Solution A | |
|---|---|
| Polybutadiene (Nippon Oil Corporation; B-2000) | 12 kg |
| Ethyl acetate | 7 kg |

-continued

| Solution B | |
|---|---|
| Acid process gelatin | 1 kg |
| Pure water | 22 kg |
| Cationic polymer (P-1) (a 20% solution) | 4 kg |
| Saponin (a 20% solution) | 3 kg |

Preparation of the Ink Absorbing Layer

Using the dispersion solutions prepared above, each additive described below was sequentially mixed while stirring at 40° C. to prepare each solution.

| Coating Composition for the First Layer; or Undermost Layer | |
|---|---|
| Silica Dispersion Solution (A-1) | 590 ml |
| Polyvinyl alcohol (a 7% solution) (produced by Kuraray Co., Ltd.) | 240 ml |
| Emulsion resin (produced by Sumitomo Chemical Co., Ltd.; Sumikaflex S-401) | 15 ml |
| Oil Dispersion Solution (B-1) | 45 ml |
| Amphoteric surface active agent (produced by NEOS CO., LTD.; FTERGENT 400S) (a 4% solution) | 2 ml |
| Water to make | 1,000 ml |
| **Coating Composition for the Second Layer** | |
| Silica Dispersion Solution (A-1) | 600 ml |
| Polyvinyl alcohol (a 7% solution) (PVA235, produced by Kuraray Co., Ltd.) | 280 ml |
| Emulsion resin (produced by Sumitomo Chemical Co., Ltd.; Sumikaflex S-401) | 10 ml |
| Oil Dispersion Solution (B-1) | 20 ml |
| Zirconium compound (produced by DAIICHI KIGENSO KAGAKU KOGYO CO., LTD.; Zircosol ZA-30) | 10 ml |
| Water to make | 1,000 ml |
| **Coating Composition for Third Layer; or Uppermost Layer** | |
| Silica Dispersion Solution (A-1) | 580 ml |
| Polyvinyl alcohol (a 7% solution) (produced by Kuraray Co., Ltd.; PVA 235) | 280 ml |
| Saponin (a 20% solution) | 2 ml |
| Amphoteric surface active agent (produced by NEOS CO., LTD.; FTERGENT 400S) (a 4% solution) | 6 ml |
| Water to make | 1,000 ml |

The thus prepared coating compositions were each filtered to an accuracy of 10 μm, employing filters produced by Advantech Toyo Kaisha, Ltd.

Preparation of Recording Sheet-1: Being this Invention

Next, each of the foregoing coating compositions was coated to the wet layer-thickness described below onto the recording surface side of the support having a 190 g/m$^2$ basis weight of the base paper, both sides of which was covered with polyethylene (to a thickness on the support of 260 μm, with anatase type titanium oxide being contained in 6 weight % in the recording surface side polyethylene layer), and after cooling at 8° C. airflow for 10 sec., dried with heated air of 40° C. to obtain Recording Sheet-1.

| Wet Layer-Thickness | |
|---|---|
| The first layer: | 65 μm |
| The second layer: | 65 μm |
| The third layer: | 40 μm |

Preparation of Recording Sheet-2: Being this Invention

Recording Sheet-2 was prepared in the same manner as preparation of foregoing Recording Sheet-1, except that Oil Dispersion Solution (B-1) was replaced with Oil Dispersion Solution (B-2)

Preparation of Recording Sheet-3: Being this Invention

Recording Sheet-3 was prepared in the same manner as preparation of foregoing Recording Sheet-1, except that B-1000 (produced by NIPPON SODA CO., LTD.) in Oil Dispersion Solution (B-1) was replaced with B-3000 (produced by Nippon Oil Corporation).

Preparation of Recording Sheet-4: Being this Invention

Recording Sheet-4 was prepared in the same manner as preparation of foregoing Recording Sheet-2, except that B-2000 (produced by Nippon Oil Corporation) in Oil Dispersion Solution (B-2) was replaced with Polyoil 110 (produced by ZEON CORPORATION).

Preparation of Recording Sheet-5: Being this Invention

Recording Sheet-5 was prepared in the same manner as preparation of foregoing Recording Sheet-1, except that Silica Dispersion Solution (A-1) in the third layer (the uppermost layer) was changed to Alumina Dispersion Solution (A-2).

Preparation of Recording Sheet-6: Being this Invention

Recording Sheet-6 was prepared in the same manner as preparation of foregoing Recording Sheet-2, except that the third layer (the uppermost layer) coating composition was prepared under the following conditions.

Coating Composition for Third Layer; or Uppermost Layer

| | |
|---|---|
| 8% Alumina hydride (produced by CATALYSTS & CHEMICALS IND. CO., LTD.; Cataloid AS-1) | 800 ml |
| Polyvinyl alcohol (a 7% solution), (produced by Kuraray Co., Ltd.; PVA 235) | 114 ml |
| Saponin (a 20% solution) | 2 ml |
| Amphoteric surface active agent (produced by NEOS CO., LTD.; FTERGENT 400 S) (a 4% solution) | 6 ml |
| Water to make | 1,000 ml |

Preparation of Recording Sheet-7: Being this Invention

Recording Sheet-7 was prepared in the same manner as preparation of foregoing Recording Sheet-1, except that 2bromo-2-nitro-1,3-propenediol was included as an antimicrobial agent of 50 ppm as an active substance in Oil Dispersion Solution (B-1) of the first and second layers.

Preparation of Recording Sheet-8: Being this Invention

Recording Sheet-8 was prepared in the same manner as preparation of foregoing Recording Sheet-1, except that polybutadiene (produced by NIPPON SODA CO., LTD.; B-1000) in Oil Dispersion Solution (B-1) was replaced with polyisoplene (produced by Idemitsu Petrochemical Co., Ltd.; Poly ip).

Preparation of Recording Sheet-9: Being this Invention

Recording Sheet-9 was prepared in the same manner as preparation of foregoing Recording Sheet-3, except that saponin in Oil Dispersion Solution was replaced with QUATAMIN 24P (produced by Kao Corporation, being a cationic surface active agent).

Preparation of Recording Sheet-10: Being this Invention

Recording Sheet-10 was prepared in the same manner as preparation of foregoing Recording Sheet-1, except that the zirconium compound was not added to the second layer.

Preparation of Recording Sheet-11: Being Comparative Example

Recording Sheet-11 was prepared in the same manner as preparation of foregoing Recording Sheet-1, except that Oil Dispersion Solution (B-1) was eliminated from the first and second layers.

Preparation of Recording Sheet-12: Being Comparative Example

Recording Sheet-12 was prepared in the same manner as preparation of foregoing Recording Sheet-1, except that Oil Dispersion Solution (B-1) was replaced with 2-butene-1,4-diol of 32% aqueous solution.

Preparation of Recording Sheet-13: Being Comparative Example

Recording Sheet-13 was prepared in the same manner as preparation of foregoing Recording Sheet-1, except that polybutadiene in Oil Dispersion Solution (B-1) was replaced with DIDP (diisodecyl phthalate).

Preparation of Recording Sheet-14: Being Comparative Example

Recording Sheet-14 was prepared in the same manner as preparation of foregoing Recording Sheet-1, except that polybutadiene in Oil Dispersion Solution (B-1) was replaced with an anti-oxidizing agent (produced by Sumitomo Chemical Co., Ltd., Sumilizer MDP-S).

Preparation of Recording Sheets-15, 16 and 17:

Each sheet (Sheets-15, 16 and 17) was prepared in the same manner as preparation of foregoing Recording Sheet-2, except that B-2000 in Oil Dispersion Solution (B-2) was replaced with a polymer, Kuraprene LIR-30, Kuraprene LIR-300 And JSR PB-810, respectively. Kuraprene LIR-30 is a isoprene compound; Kuraprene LIR-300 and JSR PB-810 each is a polybutadiene compound.

Characteristics Evaluation of Recording Sheet

Recording Sheets-1 through 14 prepared as above were each evaluated with regard to the following criteria.

Gas Discoloration Characteristics

Each of the recording sheets prepared above was evaluated for gas discoloration characteristics by the treatment of 6 ppm in an ozone atmosphere for 12 hrs., after printing of solid of M (magenta) and C (cyan) images and landscape images using Ink-jet Printer PM-950C manufactured by Seiko Epson Corporation. Gas discoloration characteristics were evident with residual ratio of the initial density.

Ink Absorbability

After solid blue images were printed using Ink-jet Printer PM-900C manufactured by Seiko Epson Corporation, ink absorbability was evaluated by visual observation based on the following criteria.

A: Next to none uneven print density was observed in the printed area.

B: Spotty mottling was observed to some degree in the printed area.

C: Spotty mottling was significant in the printed area.

A and B in the above ranking were judged to result in no practical problem.

Glossiness

Glossiness of the recording surface side was determined to be 60 degrees glossiness using a gloss meter (VGS-1001DP) manufactured by Nippon Denshoku Kogyo Co., Ltd.

Delamination

After printing of landscape images onto the recording sheets prepared above, the printed sheets were exposed to wind and rain, after which the film surfaces were visually observed.

A: Almost no delamination was observed in the printed area on the film surface.

B: Slight delamination was observed in the printed area on the film surface.

C: Almost the entire printed area on the film surface were peeled away.

A and B in the above ranking were judged to result in no practical problem.

TABLE 1

| Recording Sheet | | 1,2-bonded type | Carbon number | Gas Discoloration Characteristics | | Ink | | | |
|---|---|---|---|---|---|---|---|---|---|
| No. | Compound | PBD | (Ca.) | M | C | Absorbability | Glossiness | Delamination | Remarks |
| 1 | B-1000 (NIPPON SODA Co., Ltd.) | ca. 85% | 75 | 98% | 95% | A | 40 | A | Inv. |
| 2 | B-2000 (Nippon Oil Corporation) | ca. 65% | 150 | 97% | 94% | A | 39 | A | Inv. |
| 3 | B-3000 (Nippon Oil Corporation.) | ca. 68% | 225 | 96% | 94% | A | 39 | A | Inv. |
| 4 | Polyoil 110 (Nippon ZEON Co. Ltd.) | ca. 1% | 120 | 92% | 90% | A | 38 | B | Inv. |
| 5 | B-1000 (NIPPON SODA Co., Ltd.) | ca. 85% | 75 | 98% | 94% | A | 42 | A | Inv. |
| 6 | B-2000 (Nippon Oil Corporation) | ca. 65% | 150 | 97% | 96% | A | 41 | A | Inv. |
| 7 | B-1000 (NIPPON SODA Co., Ltd.) | ca. 85% | 75 | 99% | 95% | A | 39 | A | Inv. |
| 8 | Poly ip (Idemitsu Petrochemical Co., Ltd.) | — | 200 | 91% | 90% | A | 38 | B | Inv. |
| 9 | B-3000 (Nippon Oil Corporation) | ca. 68% | 225 | 94% | 95% | A | 39 | A | Inv. |

TABLE 1-continued

| Recording Sheet No. | Compound | 1,2-bonded type PBD | Carbon number (Ca.) | Gas Discoloration Characteristics M | Gas Discoloration Characteristics C | Ink Absorbability | Glossiness | Delamination | Remarks |
|---|---|---|---|---|---|---|---|---|---|
| 10 | B-1000 (NIPPON SODA Co., Ltd.) | ca. 85% | 75 | 97% | 95% | A | 40 | A | Inv. |
| 11 | None | — | — | 70% | 60% | A | 34 | C | Comp. |
| 12 | 2-butene-1,4-diol | — | 4 | 82% | 75% | A | 36 | C | Comp. |
| 13 | DIDP | — | 28 | 77% | 68% | B | 35 | C | Comp. |
| 14 | Anti-oxidizing agent | — | 23 | 85% | 80% | B | 35 | C | Comp. |
| 15 | Kuraprene LIR-30 (Kuraray Co. Ltd.) | — | 2100 | 90% | 91% | B | 37 | B | Inv. |
| 16 | Kuraprene LIR-300 (Kuraray co. Ltd.) | — | 3300 | 95% | 93% | B | 39 | B | Inv. |
| 17 | JSR PB-810 (JSR) | ca. 90% | 11000 | 85% | 86% | B | 35 | C | Comp. |

Inv.: This Invention
Comp.: Comparative Example
ca.: about

As is apparent from Table 1, it is proved that the recording sheet of this invention exhibits excellent ink absorbability and superiority in anti-discoloration effects, and is also a higher glossiness ink-jet recording sheet with reduced film layer delamination, compared to the comparative examples.

Example 2

Recording Sheets-18 and 19 were prepared in the same manner as preparation of foregoing Recording Sheet-1, except that polyvinyl alcohols contained in a 7% solution of polyvinyl alcohol, which were added to the coating compositions for the first, second and third layer, were changed as described in Table 2.

TABLE 2

| Recording Sheet No. | Polyvinyl Alcohol: Average degree of Polymerization | Polyvinyl Alcohol: Degree of Saponification | Gas Discoloration Characteristics M | Gas Discoloration Characteristics C | Ink Absorbability | Film Layer Glossiness | Film Layer Delamination | Remarks |
|---|---|---|---|---|---|---|---|---|
| 1 | 3500 | 88% | 98% | 95% | A | 40 | A | Inv. |
| 18 | 3500 | 99% | 98% | 95% | A | 42 | A | Inv. |
| 19 | 4500 | 98% | 98% | 95% | A | 45 | A | Inv. |

As is apparent from the results shown in Table 2, it is proved that the use of polyvinyl alcohol having a degree of saponification of at least 90% in this invention is quite effective to enhance the glossiness of the recording materials. It is also evident that the use of polyvinyl alcohol having a high average degree of polymerization is specifically preferable.

According to the present invention, it is possible to provide a very gloss ink-jet recording sheet which exhibits excellent ink absorbability and superiority in anti-gas discoloration effect, and prevents film layer delamination.

Example 3

Preparation of Silica Dispersion Solution D-1

To 110 L of aqueous solution C-1 (pH: 2.5, containing 2 g of anti-foaming agent SN-381 produced by San Nopco Ltd.) containing 12% of cationic polymer P-1b, 10% of n-propanol and 2% of ethanol, 400 L of Silica Dispersion Solution B-1 (pH: 2.6, ethanol content: 0.5%) containing 25% of a gas phase method silica with a primary particle diameter of 0.007 μm, dispersed uniformly in advance (produced by Nippon Aerosil Co., Ltd., Aerosil 300), was added at room temperature while stirring at 3,000 rpm. After that, 54 L of mixed aqueous solution A-1 of boric acid and borax at a weight ratio of 1:1 (3% of each content) were gradually added to the above solution.

Then, the resulting mixture was dispersed using a high pressure homogenizer manufactured by Sanwa Industries Co., Ltd. at a pressure of 3,000 N/cm$^2$, after which the total amount was brought to 630 L with water to obtain almost transparent Silica Dispersion Solution D-1.

Preparation of Silica Dispersion Solution D-2

To 120 L of aqueous solution C-2 (pH: 2.5) containing 12% of cationic polymer P-2b, 10% of n-propanol and 2% of ethanol, added was 400 L of foregoing Silica Dispersion Solution B-1 at room temperature while stirring at 3,000 rpm, after which 52 L of foregoing mixed aqueous solution A-1 was gradually added while stirring. After that, the resulting mixture was dispersed using a high pressure homogenizer manufactured by Sanwa Industries Co., Ltd. at a pressure of 3,000 N/cm$^2$, after which the total amount was brought to 630 L with water to obtain almost transparent Silica Dispersion Solution D-2.

Foregoing Silica Dispersion Solutions D-1 and D-2 were each filtered to an accuracy of 30 μm, employing TCP-30 type filters produced by Advantech Toyo Kaisha, Ltd.

Preparation of the Oil Dispersion Solution

To 45 kg of ethyl acetate, heated to dissolve were 20 kg of diisodecyl phthalate and 20 kg of an anti-oxidizing agent (AO-1), after which the mixture was blended with a gelatin solution containing 8 kg of an acid process gelatin, 2.9 kg of cationic polymer P-1 and 5 kg of saponin. After that, the resulting mixture was dispersed to emulsify using a high pressure homogenizer, after which the total amount was brought to 300 L with water to obtain the Oil Dispersion Solution.

AO-1

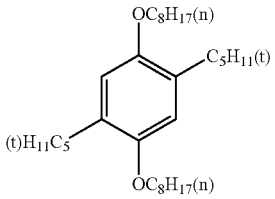

Preparation of the Coating Composition

Using each of the dispersion solutions prepared above, each of the coating compositions for porous ink receiving layers were prepared by sequential addition of each additive described below. Each of the added amounts is shown as an amount per L of the coating composition.

| Coating Composition for the First Layer; or Undermost Layer | |
|---|---|
| Silica Dispersion Solution D-1 | 580 ml |
| Polyvinyl alcohol (a 10% solution) (PVA 203 produced by Kuraray Co., Ltd.) | 5 ml |
| Polyvinyl alcohol (a 5% solution) (average degree of polymerization: 3,800, degree of saponification: 88%) | 290 ml |
| Oil Dispersion Solution | 30 ml |
| Latex Dispersion Solution (AE-803 produced by SHOWA HIGHPOLYMER CO., LTD.) | 42 ml |
| Ethanol | 8.5 ml |
| Water to make | 1,000 ml |

| Coating Composition for the Second Layer | |
|---|---|
| Silica Dispersion Solution D-1 | 580 ml |
| Polyvinyl alcohol (a 10% solution) (PVA 203 produced by Kuraray Co., Ltd.) | 5 ml |
| Polyvinyl alcohol (a 5% solution) (average degree of polymerization: 3,800, degree of saponification: 88%) | 270 ml |
| Oil Dispersion Solution | 20 ml |
| Latex Dispersion Solution (AE-803 produced by SHOWA HIGHPOLYMER CO., LTD.) | 22 ml |
| Ethanol | 8 ml |
| Water to make | 1,000 ml |

| Coating Composition for the Third Layer | |
|---|---|
| Silica Dispersion Solution D-2 | 630 ml |
| Polyvinyl alcohol (a 10% solution) (PVA 203 produced by Kuraray Co., Ltd.) | 5 ml |
| Polyvinyl alcohol (a 5% solution) (average degree of polymerization: 3,800, degree of saponification: 88%) | 270 ml |
| Oil Dispersion Solution | 10 ml |
| Latex Dispersion Solution (AE-803 produced by SHOWA HIGHPOLYMER CO., LTD.) | 5 ml |
| Ethanol | 3 ml |
| Water to make | 1,000 ml |

-continued

| Coating Composition for the Fourth Layer; or the Uppermost Layer | |
|---|---|
| Silica Dispersion Solution D-2 | 660 ml |
| Polyvinyl alcohol (a 10% solution) (PVA 203 produced by Kuraray Co., Ltd.) | 5 ml |
| Polyvinyl alcohol (a 5% solution) (average degree of polymerization: 3,800, degree of saponification: 88%) | 250 ml |
| Cationic surface active agent-1 (a 4% solution) | 3 ml |
| Saponin (a 25% solution) | 2 ml |
| Ethanol | 3 ml |
| Water to make | 1,000 ml |

Cationic Surface Active Agent

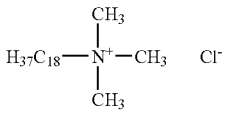

Each of the Coating Compositions was filtered to an accuracy of 20 μm, employing TCPD-30 type filters produced by Advantech Toyo Kaisha, Ltd., followed by filtration employing TCPD-10 filters.

Preparation of Recording Sheet-1A

Next, the 4 layers of the foregoing coating compositions were coated simultaneously to the wet layer-thickness described below onto the paper support, both sides of which were covered with polyethylene, at 40° C. using a slide hopper type coater.

| Wet Layer-Thickness | |
|---|---|
| The first layer: | 42 μm |
| The second layer: | 39 μm |
| The third layer: | 44 μm |
| The fourth layer: | 38 μm |

The foregoing paper support was a roll of about 1.5 m wide and about 4,000 m long, as mentioned below.

The employed paper support had an 8% moisture content and the surface side of a 170 g basis weight photographic paper base was coated with polyethylene containing 6% of anatase type titanium oxide at 35 μm thickness using extrusion melting coating, after which the reverse side was coated with 40 μm polyethylene using extrusion melting coating. The surface side was subjected to a corona discharge treatment, after which the subbing layer was coated with polyvinyl alcohol (PVA 235, produced by Kuraray Co., Ltd.) to be 0.05 g per $m^2$ of the recording sheet. The reverse side was also subjected to a corona discharge treatment, after which the backing layer was coated, which contained about 0.4 g of a styrene-acrylate latex binder having a Tg of about 80° C., 0.1 g of an anti-static agent (a cationic polymer), and 0.1 g of about a 2 μm diameter silica particles as a matting agent per $m^2$ of the recording sheet.

Drying after coating of the porous ink receiving layer was conducted to lower the emulsion side temperature to 13° C. by passing it through a cooling zone maintaining at 5° C. for 15 sec., after which the temperature of plurally provided drying zones was appropriately set to dry, the layer and the thus dried recording medium was wound up into a roll to obtain Comparative Recording Sheet-1A.

Preparation of Recording Sheet 2A

Poly oil 130 (produced by ZEON Corp.; at a number average molecular weight of 3,000) was dissolved in ethyl acetate, and the ethyl acetate solution was over-coated onto Recording Sheet-lA so that the added amount of Poly oil 130 to the porous ink receiving layer was 1.0 g/m$^2$ to obtain Recording Sheet-2A.

Preparation of Recording Sheet-3A

Recording Sheet-3A was prepared in the same manner as preparation of Recording Sheet-2A, except that the anti-oxidizing agent (AO-1) was replaced with Sumilizer MDP-D (produced by Sumitomo Chemical Co., Ltd.) in preparation of an Oil Dispersion Solution.

Preparation of Recording Sheet-4A

Recording Sheet-4A was prepared in the same manner as preparation of Recording Sheet-2A, except that the anti-oxidizing agent (AO-1) was replaced with Irganox 1520 (produced by Ciba Specialty Chemicals) in preparation of an Oil Dispersion Solution.

Preparation of Recording Sheet-5A

Recording Sheet-5A was prepared in the same manner as preparation of Recording Sheet-2A, except that the anti-oxidizing agent (AO-1) was replaced with Sumilizer GA-80 (produced by Sumitomo Chemical Co., Ltd.) in preparation of an Oil Dispersion Solution.

Preparation of Recording Sheet-6A

Recording Sheet-6A was prepared in the same manner as preparation of Recording Sheet-1A, except that the anti-oxidizing agent (AO-1) was replaced with Sumilizer TPL-R (produced by Sumitomo Chemical Co., Ltd.) in preparation of an Oil Dispersion Solution.

Preparation of Recording Sheet-7A

Recording Sheet-7A was prepared in the same manner as preparation of Recording Sheet-2A, except that the anti-oxidizing agent (AO-1) was replaced with Adekastab PEP-8 (produced by ASAHI DENKA CO., LTD.) in preparation of an Oil Dispersion Solution.

Preparation of Recording Sheet-8A

Recording Sheet-8A was prepared in the same manner as preparation of Recording Sheet-1A, except that the anti-oxidizing agent (AO-1) was replaced with Adekastab HP-10 (produced by ASAHI DENKA CO., LTD.) in preparation of an Oil Dispersion Solution.

Preparation of Recording Sheet-9A

Recording Sheet-9A was prepared in the same manner as preparation of Recording Sheet-1A, except that the anti-oxidizing agent (AO-1) was replaced with TINUVIN 171 (produced by Ciba Specialty Chemicals) in preparation of an Oil Dispersion Solution.

Preparation of Recording Sheet-10A Recording Sheet-10A was prepared in the same manner as preparation of Recording Sheet-lA, except that the anti-oxidizing agent (AO-1) was replaced with Poly Oil 110 (produced by ZEON Corp.; at a number average molecular weight of 1,600) in preparation of the Oil Dispersion Solution, and a magnesium sulfate aqueous solution was over-coated so that the added amount of magnesium sulfate to the porous ink receiving layer was 1.0 g/m$^2$.

Preparation of Recording Sheet-11A

Recording Sheet-11A was prepared in the same manner as preparation of Recording Sheet-10A, except that the magnesium sulfate aqueous solution in Recording Sheet-10A was replaced with N,N-bissulfoethylhydroxyl amine aqueous solution.

Preparation of Recording Sheet-12A

Recording Sheet-12A was prepared in the same manner as preparation of Recording Sheet-10A, except that the magnesium sulfate aqueous solution in Recording Sheet-10A was replaced with a calcium chloride aqueous solution.

Preparation of Recording Sheet-13A

Recording Sheet-13A was prepared in the same manner as preparation of Recording Sheet-10A, except that the magnesium sulfate aqueous solution in Recording Sheet-10A was replaced with ethyl acetate of HCA (produced by SANKO CO., LTD.).

Preparation of Recording Sheet-14A

Recording Sheet-14A was prepared in the same manner as preparation of Recording Sheet-10A, except that the magnesium sulfate aqueous solution in Recording Sheet-10A was replaced with an L-ascorbic acid aqueous solution.

Preparation of Recording Sheet-15A

Recording Sheet-15A was prepared in the same manner as preparation of Recording Sheet-10A, except that the magnesium sulfate aqueous solution in Recording Sheet-10A was replaced with an ethyl acetate solution of Adekastab LA-31 produced by ASAHI DENKA CO., LTD.).

Preparation of Recording Sheet-16A

Recording Sheet-16A was prepared in the same manner as preparation of Recording Sheet-10A, except that the magnesium sulfate aqueous solution in Recording Sheet-10A was replaced with an ethyl acetate solution of Adekastab LA-31 produced by ASAHI DENKA CO., LTD.).

Preparation of Recording Sheet-17A

Recording Sheet-17A was prepared in the same manner as preparation of Recording Sheet-1A, except that the anti-oxidizing agent (AO-1) was replaced with Poly bd R45HT (produced by Idemitsu Petrochemical Co., Ltd.; at a number average molecular weight of 2,800) in preparation of the Oil Dispersion Solution, after which 30 ml each of 2,2'-ethylenedithiodiethanol (20% aqueous solution) was added to the coating compositions for the first layer and also the second layer.

Preparation of Recording Sheet-18A

Recording Sheet-18A was prepared in the same manner as preparation of Recording Sheet-17A, except that 2,2'-ethylenedithiodiethanol in Recording Sheet-17A was replaced with the same amount of triethanol amine.

Preparation of Recording Sheet-19A

Recording Sheet-19A was prepared in the same manner as preparation of Recording Sheet-17A, except that 2,2'-ethylenedithiodiethanol, added to the coating compositions for the first and second layer in Recording Sheet-17A, was not added and 30 ml each of Zircosol-ZA (produced by DAIICHI KIGENSO KAGAKU KOGYO CO., LTD.) was added to the coating compositions for the third and fourth layers.

Preparation of Recording Sheet-20A

Recording Sheet-20A was prepared in the same manner as preparation of Recording Sheet-19A, except that Zircosol-ZA in Recording Sheet-19A was replaced with the same amount of Paho #2s (produced by Asada Kagaku, Inc.).

Preparation of Recording Sheet-21A

Recording Sheet-21A was prepared in the same manner as preparation of Recording Sheet-19A, except that Zircosol-ZA in Recording Sheet-19A was replaced with the same amount of D-glucose (10% aqueous solution).

Preparation of Recording Sheet-22A

Recording Sheet-22A was prepared in the same manner as preparation of Recording Sheet-19A, except that Zircosol-ZA in Recording Sheet-19A was replaced with the same amount of Isoeleat P (produced by ENSUIKO Sugar Refining Co., Ltd.; 10% aqueous solution).

Preparation of Recording Sheet-23A

Recording Sheet-23A was prepared in the same manner as preparation of Recording Sheet-2A, except that Actor BSH (produced by KAWAGUCHI CHEMICAL INDUSTRY CO., LTD.) of the same amount of Poly oil 130 was added to ethyl acetate solution of Poly oil 130 in Recording Sheet-2A, and the resulting solution was over-coated.

Preparation of Recording Sheet-24A

Recording Sheet-24A was prepared in the same manner as preparation of Recording Sheet-23A, except that Actor BSH (produced by KAWAGUCHI CHEMICAL INDUSTRY CO., LTD.) in Recording Sheet-23A was replaced with the same amount of SYASORB UV-3346 (produced by Cytec Industries Inc.).

Preparation of Recording Sheet-25A

Recording Sheet-25A was prepared in the same manner as preparation of Recording Sheet-23A, except that Actor BSH (produced by KAWAGUCHI CHEMICAL INDUSTRY CO., LTD.) in Recording Sheet-23A was replaced with the same amount of Adekastab LA-77 (produced by ASAHI DENKA CO., LTD.).

Preparation of Recording Sheet-26A

Recording Sheet-26A was prepared in the same manner as preparation of Recording Sheet-2A, except that the Oil Dispersion Solution was not added.

Recording Sheet-55A was prepared in the same manner as preparation of Recording Sheet-19A, except that Poly bd R45HT was replaced with the same amount of B-2000.

Ink-jet Recording Sheets 1A through 26A prepared as above were each evaluated using the following criteria.

Image Lasting Quality: Discoloration (Residual Ratio)

The Recording Sheets obtained above were printed with solid cyan images using BJ-F870 Printer manufactured by CANON INC., after which ambient air was blasted directly onto the prints for one month to evaluate Gas Discoloration Characteristics of the Images.

Further, after one day light irradiation under conditions of 70,000 lux via a Xenon Fade-o-Meter, a similar evaluation was conducted. The discoloration ratio is represented by the residual ratio of prior to the ambient air blast as a primary stage density.

Light Resistance

Using a water based ink containing 2 weight % of phthalocyanine cyan dye, 6 weight % of glycerine and 20 weight % of ethylene glycol, each Recording Sheet was printed at a gradually changing ink ejection volume using an ink-jet printer.

The obtained prints were exposed to light for ten days under the conditions of 70,000 lux via a Xenon Fade-o-Meter.

Reflection density after exposure to Xenon radiation at a 1.0 reflection density before exposure to Xenon radiation was defined as a dye residual ratio to be a yardstick for light resistance.

Bleeding

Using Ink-jet Printer PM900C manufactured by Seiko Epson Corp., thin magenta lines (at a width of 1/300×2.54 cm) was printed on the Recording Sheet samples, and the prints were set aside under conditions of 23° C. and 80% RH for one week to determine any changes of the thin line width.

TABLE 3

| Recording Sheet No. | Compound | 1,2-bonded Polybutadine | Carbon number (Ca.) | Gas Discoloration Characteristics: Cyan | Gas Discoloration After irradiation | Light Fastness | Bleeding | Remarks |
|---|---|---|---|---|---|---|---|---|
| 1A | — | — | — | 70% | 68% | 80% | 1.05 | Comp. |
| 2A | Polyoil 130 (Nippon ZEON Co. Ltd.) | ca. 1% | 230 | 95% | 93% | 81% | 1.04 | Inv. |
| 3A | Polyoil 130 (Nippon ZEON Co. Ltd.) | ca. 1% | 230 | 98% | 97% | 84% | 1.04 | Inv. |
| 4A | Polyoil 130 (Nippon ZEON Co. Ltd.) | ca. 1% | 230 | 99% | 98% | 82% | 1.03 | Inv. |
| 5A | Polyoil 130 (Nippon ZEON Co. Ltd.) | ca. 1% | 230 | 98% | 97% | 86% | 1.03 | Inv. |
| 6A | Polyoil 130 (Nippon ZEON Co. Ltd.) | ca. 1% | 230 | 96% | 95% | 80% | 1.03 | Inv. |
| 7A | Polyoil 130 (Nippon ZEON Co. Ltd.) | ca. 1% | 230 | 96% | 94% | 81% | 1.04 | Inv. |
| 8A | Polyoil 130 (Nippon ZEON Co. Ltd.) | ca. 1% | 230 | 97% | 95% | 80% | 1.04 | Inv. |
| 9A | Polyoil 130 (Nippon ZEON Co. Ltd.) | ca. 1% | 230 | 97% | 96% | 85% | 1.04 | Inv. |

TABLE 3-continued

| Recording Sheet No. | Compound | 1,2-bonded Polybutadine | Carbon number (Ca.) | Gas Discoloration Characteristics: Cyan | Gas Discoloration After irradiation | Light Fastness | Bleeding | Remarks |
|---|---|---|---|---|---|---|---|---|
| 10A | Polyoil 110 (Nippon ZEON Co. Ltd.) | ca. 1% | 120 | 95% | 93% | 87% | 1.03 | Inv. |
| 11A | Polyoil 110 (Nippon ZEON Co. Ltd.) | ca. 1% | 120 | 92% | 91% | 88% | 1.02 | Inv. |
| 12A | Polyoil 110 (Nippon ZEON Co. Ltd.) | ca. 1% | 120 | 92% | 90% | 83% | 1.02 | Inv. |
| 13A | Polyoil 110 (Nippon ZEON Co. Ltd.) | ca. 1% | 120 | 94% | 93% | 86% | 1.02 | Inv. |
| 14A | Polyoil 110 (Nippon ZEON Co. Ltd.) | ca. 1% | 120 | 93% | 91% | 86% | 1.02 | Inv. |
| 15A | Polyoil 110 (Nippon ZEON Co. Ltd.) | ca. 1% | 120 | 91% | 91% | 84% | 1.02 | Inv. |
| 16A | Polyoil 110 (Nippon ZEON Co. Ltd.) | ca. 1% | 120 | 91% | 90% | 83% | 1.03 | Inv. |
| 17A | Poly bd R45HT | ca. 20% | 210 | 94% | 94% | 82% | 1.05 | Inv. |
| 18A | Poly bd R45HT | ca. 20% | 210 | 93% | 92% | 85% | 1.01 | Inv. |
| 19A | Poly bd R45HT | ca. 20% | 210 | 93% | 91% | 83% | 1.01 | Inv. |
| 20A | Poly bd R45HT | ca. 20% | 210 | 92% | 90% | 82% | 1.03 | Inv. |
| 21A | Poly bd R45HT | ca. 20% | 210 | 93% | 90% | 83% | 1.02 | Inv. |
| 22A | Poly bd R45HT | ca. 20% | 210 | 93% | 90% | 84% | 1.03 | Inv. |
| 23A | Polyoil 130 (Nippon ZEON Co. Ltd.) | ca. 1% | 230 | 99% | 95% | 82% | 1.03 | Inv. |
| 24A | Polyoil 130 (Nippon ZEON Co. Ltd.) | ca. 1% | 230 | 98% | 96% | 85% | 1.04 | Inv. |
| 25A | Polyoil 130 (Nippon ZEON Co. Ltd.) | ca. 1% | 230 | 98% | 96% | 86% | 1.03 | Inv. |
| 26A | — | — | — | 95% | 85% | 65% | 1.04 | Comp. |
| 55A | B-2000 (Nippon Soda Co. Ltd.) | ca. 85% | 150 | 99% | 99% | 91% | 1.01 | Inv. |

Inv.: This Invention
Comp.: Comparative Example
ca.: about

As is apparent from Table 3, it is proved that the recording sheet of this invention provided improved image lasting quality and high quality images.

Based on the present invention, it is possible to provide high quality images exhibiting excellent ink absorbability, high coloring density and photographic image quality, and to provide an ink-jet recording sheet which exhibits superiority in storage stability, specifically in anti-gas discoloration effect.

Example 4

Preparation of Silica Dispersion Solution D-1

To 110 L of aqueous solution C-1 (pH: 2.5, containing 2 g of anti-foaming agent SN-381 produced by San Nopco Ltd.) containing 12% of cationic polymer P-1, 10% of n-propanol and 2% of ethanol, 400 L of Silica Dispersion Solution B-1 (pH: 2.6, ethanol content: 0.5%) containing 25% of a gas phase method silica with a primary particle diameter of 0.007 μm, dispersed uniformly in advance (produced by Nippon Aerosil Co., Ltd., Aerosil 300), was added at room temperature while stirring at 3,000 rpm. After that, 54 L of mixed aqueous solution A-1 of boric acid and borax at a weight ratio of 1:1 (3% of each component) were gradually added to the above solution.

Then, the resulting mixture was dispersed using a high pressure homogenizer manufactured by Sanwa Industries Co., Ltd. at a pressure of 3,000 N/cm$^2$, after which the total amount was brought to 630 L with water to obtain an almost transparent Silica Dispersion Solution D-1.

Preparation of Silica Dispersion Solution D-2b

To 400 L of foregoing Silica Dispersion Solution B-1, 1.0 kg of anionic fluorescent brightening agent Uvitex NFW liq. (produced by Ciba Specialty Chemicals) was added while stirring, after which the above mixture was added to 120 L of aqueous solution C-2 (pH: 2.5) containing 12% of cationic polymer P-2, 10% of n-propanol and 2% of ethanol at room temperature while stirring at 3,000 rpm. Consequently, 52 L of foregoing mixed aqueous solution A-1 was gradually added while stirring.

After that, the resulting mixture was dispersed using a high pressure homogenizer, mentioned above, at a pressure of 3,000 N/cm$^2$, after which the total amount was brought to 630 L with water to obtain almost transparent Silica Dispersion Solution D-2b.

Preparation of Silica Dispersion Solution D-3

To 400 L of foregoing Silica Dispersion Solution B-1, 0.35 kg of Dye-1 aqueous solution was added while stirring, after which the above mixture was added to 120 L of aqueous solution C-2 (pH: 2.5) containing 12% of cationic polymer P-2, 10% of n-propanol and 2% of ethanol at room temperature while stirring at 3,000 rpm. Consequently, 52 L of foregoing mixed aqueous solution A-1 was gradually added while stirring.

After that, the resulting mixture was dispersed using a high pressure homogenizer, mentioned above, at a pressure of 3,000 N/cm$^2$, after which the total amount was brought to 630 L with water to obtain almost transparent Silica Dispersion Solution D-3.

Forgoing Silica Dispersion Solutions D-1, D-2b and D-3 were each filtered to an accuracy of 30 μm, employing TCP-30 type filters produced by Advantech Toyo Kaisha, Ltd.

Preparation of Oil Dispersion Solution-1

In 45 kg of ethyl acetate, 20 kg of di-i-decyl phthalate and 20 kg of an anti-oxidizing agent (AO-1) were heated until dissolved, after which the solution was mixed with 210 L of an aqueous solution containing 8 kg of acid process gelatin, 2.9 kg of a cationic polymer P-1 and 5 kg of saponin at 55° C. After dispersion to emulsify using a high pressure homogenizer, the total amount was brought to 300 L with water to obtain Oil Dispersion Solution-1.

Preparation of Oil Dispersion Solution-2

In 45 kg of ethyl acetate, 20 kg of di-i-decyl phthalate, 20 kg of Poly oil 110 (polybutadiene produced by ZEON Corp.; at a number average molecular weight of 1,600) and 85 g of Dye-2 were heated until dissolved, after which the solution was mixed with 210 L of an aqueous solution containing 8 kg of acid process gelatin, 2.9 kg of a cationic polymer P-1 and 5 kg of saponin at 55° C. After dispersion to emulsify the solution using a high pressure homogenizer, the total amount was brought to 300 L with water to obtain Oil Dispersion Solution-2.

Preparation of the Coating Composition for the Ink Receiving Layer

Using each of the dispersion solutions prepared above, each of the coating compositions for porous ink receiving layers were prepared by sequential addition of each additive listed below. Each of the added amounts is shown as an amount per L of the coating composition.

| Coating Composition for the First Layer; being the Undermost Layer | |
|---|---|
| Silica Dispersion Solution D-1 | 580 ml |
| Polyvinyl alcohol (a 10% solution) (PVA 203 produced by Kuraray Co., Ltd.) | 5 ml |
| Polyvinyl alcohol (a 5% solution) (average degree of polymerization: 3,800, degree of saponification: 88%) | 290 ml |
| Oil Dispersion Solution-1 | 30 ml |
| Latex Dispersion Solution (AE-803 produced by SHOWA HIGHPOLYMER CO. LTD.) | 42 ml |
| Ethanol | 8.5 ml |
| Water to make | 1,000 ml |
| **Coating Composition for the Second Layer** | |
| Silica Dispersion Solution D-1 | 580 ml |
| Polyvinyl alcohol (a 10% solution) (PVA 203; mentioned above) | 5 ml |

-continued

| | |
|---|---|
| Polyvinyl alcohol (a 5% solution) (average degree of polymerization: 3,800, degree of saponification: 88%) | 270 ml |
| Oil Dispersion Solution-1 | 30 ml |
| Latex Dispersion Solution (AE-803; mentioned above) | 22 ml |
| Ethanol | 8 ml |
| Water to make | 1,000 ml |
| **Coating Composition for the Third Layer** | |
| Silica Dispersion Solution D-2b | 630 ml |
| Polyvinyl alcohol (a 10% solution) (PVA 203; mentioned above) | 5 ml |
| Polyvinyl alcohol (a 5% solution) (average degree of polymerization: 3,800, degree of saponification: 88%) | 270 ml |
| Oil Dispersion Solution-1 | 30 ml |
| Latex Dispersion Solution (AE-803; mentioned above) | 5 ml |
| Ethanol | 3 ml |
| Water to make | 1,000 ml |
| **Coating Composition for the Fourth Layer; being the Uppermost Layer** | |
| Silica Dispersion Solution D-2b | 660 ml |
| Polyvinyl alcohol (a 10% solution) (PVA 203; mentioned above) | 5 ml |
| Polyvinyl alcohol (a 5% solution) (average degree of polymerization: 3,800, degree of saponification: 88%) | 250 ml |
| Cationic surface active agent SA-1 (a 4% solution) | 3 ml |
| Saponin (a 25% solution) | 2 ml |
| Ethanol | 3 ml |
| Water to make | 1,000 ml |

The structure of the additives used in each dispersion solution and coating composition are shown below.

AO-1: 1,4-dioctyloxy-2,5-di-t-pentylbenzene

SU-1: trimethyl.octadecylammonium chloride

Dye-1

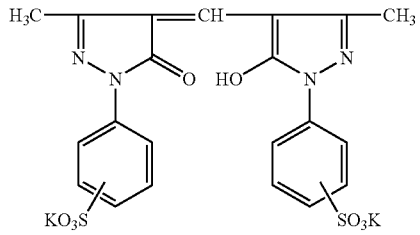

Dye-2

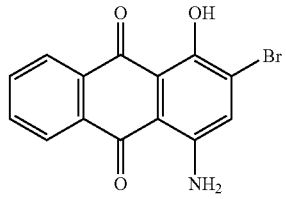

Each of the Coating Compositions was filtered to an accuracy of 20 μm, employing TCPD-30 type filters produced by Advantech Toyo Kaisha, Ltd., followed by filtration employing TCPD-10 filters.

Preparation of Recording Sheet-1B

The 4 layers of the foregoing coating compositions were coated simultaneously onto the wet layer-thickness described below onto the paper support, both sides of which were covered with polyethylene (RC paper), at 40° C. using a slide hopper type coater.

Wet Layer-Thickness

| | |
|---|---|
| The first layer: | 42 μm |
| The second layer: | 39 μm |
| The third layer: | 44 μm |
| The fourth layer: | 38 μm |

The foregoing paper support was a roll of about 1.5 m wide and about 4,000 m long, as mentioned below.

The employed paper support had an 8% moisture content and the surface side of a 170 g basis weight photographic paper base was coated with 35 μm polyethylene containing 6% of anatase type titanium oxide using extrusion melting coating, after which the reverse side was coated with 40 μm polyethylene using extrusion melting coating. The surface side was subjected to a corona discharge treatment, after which the subbing layer was coated with 0.05 g per $m^2$ polyvinyl alcohol (PVA 235, produced by Kuraray Co., Ltd.) of the recording sheet. The reverse side was also subjected to a corona discharge treatment, after which the backing layer was applied, which contained about 0.4 g of a styrene-acrylate latex binder having a Tg of about 80° C., 0.1 g of an anti-static agent (a cationic polymer), and 0.1 g of about 2 μm diameter silica particles as a matting agent per $m^2$ of the recording sheet.

Drying after coating of the porous ink receiving layer was conducted to lower the emulsion side temperature to 13° C. by passing it through a cooling zone maintaining at 5° C. for 15 sec., after which the temperature of plurally provided drying zones was appropriately set to dry, the layer and the thus dried recording medium was wound up into a roll to obtain Comparative Recording Sheet-1B.

Recording Sheets 2B through 14B were prepared in the same manner.

Recording Sheet 2B was prepared in the same manner as preparation of Recording Sheet 1B, except that the anti-oxidizing agent (AO-1) in Recording Sheet-1B was replaced with Poly bd R45HT (produced by Idemitsu Petrochemical Co., Ltd.; at a number average molecular weight of 2,800).

Recording Sheet-3B: Recording Sheet-3B was prepared in the same manner as preparation of Recording Sheet-1, except that the anti-oxidizing agent (AO-1) was replaced with Poly ip (produced by Idemitsu Petrochemical Co., Ltd.; at a number average molecular weight of 2,500) in preparation of Oil Dispersion Solution-1.

Recording Sheet-4B: Recording Sheet-4B was prepared in the same manner as preparation of Recording Sheet-1B, except that the anti-oxidizing agent (AO-1) was replaced with Poly oil 130 (produced by ZEON Corp.; at a number average molecular weight of 3,000) in preparation of Oil Dispersion Solution-1.

Recording Sheet-5B: Recording Sheet-5B was prepared in the same manner as preparation of Recording Sheet-1, except that the anti-oxidizing agent (AO-1) was replaced with Poly oil 110 (produced by ZEON Corp.; at a number average molecular weight of 1,600) in preparation of Oil Dispersion Solution-1.

Recording Sheet-6B: Recording Sheet-6B was prepared in the same manner as preparation of Recording Sheet-1, except that the anti-oxidizing agent (AO-1) was replaced with Nisso PB B-1000 (produced by NIPPON SODA CO., LTD.; at a number average molecular weight of 900–1,300) in preparation of Oil Dispersion Solution-1.

Recording Sheet-7B: Recording Sheet-7B was prepared in the same manner as preparation of Recording Sheet-1, except that the anti-oxidizing agent (AO-1) was replaced with Nisseki Polybutadiene E-1000-8 (produced by Nippon Oil Corporation; at a number average molecular weight of about 1,000) in preparation of Oil Dispersion Solution-1.

Recording Sheet-8B: This sheet was prepared in the same manner as preparation of Recording Sheet-1B, except that the anti-oxidizing agent (AO-1) was replaced with DAISO DAP S (produced by DAISO CO., LTD.; average molecular weight of about 35,000) in preparation of Oil Dispersion Solution-1.

Recording Sheet-9B: Recording Sheet-9B was prepared in the same manner as preparation of Recording Sheet-1B, except that the Oil Dispersion Solution-1 in the Coating Compositions for the First to Third Layer was replaced with the same amount of modified styrene-butadiene latex LX438C (produced by ZEON Corp.).

Recording Sheet-10B: Poly bd R45HT (produced by Idemitsu Petrochemical Co., Ltd.; number average molecular weight of 2,800) was dissolved in ethyl acetate to prepare 10% solution, after which the solution was coated uniformly onto Recording Sheet-1B with a spray coating method to make the coating weight of Poly bd R45HT 0.5 g/m2 and dried to obtain Recording Sheet-10B.

Recording Sheet-10B: Recording Sheet-11B was prepared in the same manner as preparation of Recording Sheet-10B, except that Poly bd R45HT was replaced with Poly oil 130 (produced by ZEON Corp.).

Recording Sheet-12B: Recording Sheet-12B was prepared in the same manner as preparation of Recording Sheet-10B, except that Poly bd R45HT was replaced with Hycar ATBN1300X16 (produced by ZEON Corp.; at a number average molecular weight of 3,000–3,500).

Recording Sheet-13B: Recording Sheet-13B was prepared in the same manner as preparation of Recording Sheet-10B, except that Poly bd R45HT was replaced with JSR RB-810 (produced by JSR Corp.; at an average molecular weight of 150,000).

Recording Sheet-14B: Recording Sheet-14B was prepared in the same manner as preparation of Recording Sheet-1B, except that Silica Dispersion Solution D-2 was replaced with the same amount of Silica Dispersion Solution D-3, and Oil dispersion Solution-1 was replaced with Oil Dispersion Solution-2.

Ink-jet Recording Sheets 1B through 14B prepared above were each evaluated for the following characteristics.

Image Lasting Quality

The Recording Sheets obtained above were printed with solid cyan images using a BJ-F870 printer manufactured by CANON INC., after which ambient air was blasted directly onto the prints for one month to evaluate Gas Discoloration Characteristics of the images using the residual ratio of the initial density.

White Background Fluctuation

A color difference of ΔE was determined using a densitometer X-Rite 938 manufactured by X-Rite Incorporated., which was a difference between before and after the ambient air blast to the unprinted area of the recording sheet used for the foregoing Image Lasting Quality test. ΔE was calculated based on the following formula.

$$\Delta E=\{(L^*-L^{*\prime})^2+(a^*-a^{*\prime})^2+(b^*-b^{*\prime})^2\}^{1/2}$$

wherein L*, a*, b* and L*', a*' and b*' represented the value measured before and after the Image Lasting Quality test respectively.

Degree of Whiteness

Recording Sheets 1B through 13B which contained the fluorescent brightening agent in the ink receiving layer exhibited slightly bluish brilliant white. Further, Recording Sheet 14B containing Dye-1 and Dye-2 exhibited a color tone of close to the standard paper for printing (a standard art paper defined in Japan Color).

The evaluation results of each Recording Sheet are shown to bring together in Table 4.

TABLE 4

| Recording Sheet No. | Compound | 1,2-bonded Polybutadine | Carbon number (Ca.) | Gas Discoloration Characteristics: Cyan | Whiteness: delta | L* | a* | b* | Remarks |
|---|---|---|---|---|---|---|---|---|---|
| 1B | — | — | — | 70% | 6.4 | 95.5 | 3.15 | −9.82 | Comp. |
| 2B | Poly bd R45HT | ca. 20% | 210 | 94% | 1.5 | 95.3 | 3.22 | −9.84 | Inv. |
| 3B | Poly ip | — | 200 | 95% | 1.6 | 95.7 | 3.23 | −9.99 | Inv. |
| 4B | Polyoil 130 (Nippon ZEON Co. Ltd.) | ca. 1% | 230 | 95% | 1.8 | 95.9 | 3.11 | −9.79 | Inv. |
| 5B | Polyoil 110 (Nippon ZEON Co. Ltd.) | ca. 1% | 120 | 94% | 1.6 | 95.4 | 3.18 | −9.76 | Inv. |
| 6B | B-1000 (NIPPON SODA Co., Ltd.) | ca. 85% | 75 | 95% | 1.6 | 95.3 | 3.20 | −9.80 | Inv. |
| 7B | E-1000-8 (Nippon Petrochemicals Co., Ltd.) | ca. 58% | 70 | 94% | 1.7 | 95.4 | 3.10 | −9.90 | Inv. |
| 10B | Poly bd R45HT | ca. 20% | 210 | 95% | 1.1 | 95.6 | 3.13 | −9.73 | Inv. |
| 11B | Polyoil 130 (Nippon ZEON Co. Ltd.) | ca. 1% | 230 | 94% | 1.2 | 95.3 | 3.15 | −9.70 | Inv. |
| 12B | Hycar ATBN1300 × 16 (Ube Industries Ltd.) | — | 230 | 65% | 1.3 | 95.2 | 3.20 | −9.72 | Inv. |
| 14B | Polyoil 110 (Nippon ZEON Co. Ltd.) | ca. 1% | 120 | 95% | 1.3 | 93.1 | −0.24 | 1.33 | Inv. |

Inv.: This Invention

Comp.: Comparative Example ca.: about

As prove by the examples, the ink-jet recording sheet of the present invention exhibited improved image storage stability and smaller white background fluctuation.

What is claimed is:

1. An ink-jet recording sheet, comprising a support having thereon a porous ink receiving layer, the porous ink receiving layer including inorganic particles, a hydrophilic binder and a polymer, wherein the polymer has a plurality of carbon-carbon unsaturated bonds, provided that the unsaturated bonds are non-aromatic; the polymer has 70 to 1000 carbon atoms in the molecule; and the polymer contains 1,2-polybutadiene in an amount of not less than 60 weight % based on the total weight of the polymer.

2. The ink-jet recording sheet of claim 1, wherein the polymer consists of polybutadiene.

3. The ink-jet recording sheet of claim 1, wherein the porous ink receiving layer further contains a anti-discoloration agent.

4. The ink-jet recording sheet of claim 3, wherein the anti-discoloration agent is selected from the group consisting of:

(i) phenol compounds;

(ii) sulfur containing compounds;

(iii) amine compounds;

(iv) multivalent metal salts;

(v) phosphor containing compounds;

(vi) alcohols; and (vii) benzotriazoles or benzophenones.

5. The ink-jet recording sheet of claim 1, wherein the porous ink receiving layer further contains a fluorescent whitening agent.

6. The ink-jet recording sheet of claim 1, wherein the porous ink receiving layer further contains a surface active agent.

7. The ink-jet recording sheet of claim 1, wherein the inorganic particles are silica, alumina or alumina hydrate.

8. The ink-jet recording sheet of claim 1, wherein the inorganic particles have an average particle diameter of not more than 200 nm.

9. The ink-jet recording sheet of claim 1, wherein the porous ink receiving layer further contains a cationic polymer.

10. The ink-jet recording sheet of claim 1, wherein the porous ink receiving layer further contains an antimicrobial agent.

11. The ink-jet recording sheet of claim 1,wherein the porous ink receiving layer further contains a polyvinyl alcohol having an average polymerization degree of not less than 3000.

* * * * *